US010842706B2

(12) United States Patent
Fawcett et al.

(10) Patent No.: US 10,842,706 B2
(45) Date of Patent: Nov. 24, 2020

(54) ELEVATING WALKER CHAIR

(71) Applicant: Exokinetics, Inc., Pottstown, PA (US)

(72) Inventors: John Christopher Fawcett, Whitehead (GB); Garrett W. Brown, Philadelphia, PA (US)

(73) Assignee: Exokinetics, Inc., West Chester, PA (US)

( * ) Notice: Subject to any disclaimer, the term of this patent is extended or adjusted under 35 U.S.C. 154(b) by 517 days.

(21) Appl. No.: 15/326,113

(22) PCT Filed: Jul. 10, 2015

(86) PCT No.: PCT/US2015/040036

§ 371 (c)(1),
(2) Date: Jan. 13, 2017

(87) PCT Pub. No.: WO2016/010863

PCT Pub. Date: Jan. 21, 2016

(65) Prior Publication Data

US 2017/0209319 A1 Jul. 27, 2017

Related U.S. Application Data

(60) Provisional application No. 62/024,006, filed on Jul. 14, 2014.

(51) Int. Cl.
*A61H 3/04* (2006.01)
*A61G 5/14* (2006.01)
(Continued)

(52) U.S. Cl.
CPC ..... *A61H 3/04* (2013.01); *A61G 5/048* (2016.11); *A61G 5/125* (2016.11); *A61G 5/14* (2013.01);
(Continued)

(58) Field of Classification Search
CPC .. A61G 7/1059; A61G 7/1017; A61G 7/1051; A61G 5/14; A61G 5/048;
(Continued)

(56) References Cited

U.S. PATENT DOCUMENTS 656,854 A 8/1900 Nord
1,030,801 A 6/1912 Berault
(Continued)

FOREIGN PATENT DOCUMENTS

EP 1627619 2/2006
GB 1406420 A 9/1975
(Continued)

OTHER PUBLICATIONS

Partial Supplementary European Search Report issued by the European Patent Office dated Jun. 13, 2018 in European Patent Application No. 15 822 239.8.
(Continued)

*Primary Examiner* — David R Hare
(74) *Attorney, Agent, or Firm* — Joan T. Kluger; Barnes & Thornburg LLP

(57) ABSTRACT

An elevating walker chair that allows both riding and walking. The chair elevates by a parallelogram power unit. The seat transforms between a saddle and seat upon changes in saddle/seat elevation. Also a lifting parallelogram power unit structure. Disclosed is an elevating walker chair for people with limited mobility resulting from compromised musculature, coordination or balance, or for able bodied individuals that must perform tasks for which assistance is desired.

24 Claims, 36 Drawing Sheets

(51) Int. Cl.
*A61G 5/12* (2006.01)
*A61G 5/04* (2013.01)
*A61G 7/10* (2006.01)

(52) U.S. Cl.
CPC ..... *A61G 7/1017* (2013.01); *A61G 7/1051* (2013.01); *A61G 7/1059* (2013.01); *A61H 2003/043* (2013.01); *A61H 2201/0107* (2013.01); *A61H 2201/0192* (2013.01); *A61H 2201/1633* (2013.01); *A61H 2201/1635* (2013.01); *A61H 2201/5097* (2013.01)

(58) Field of Classification Search
CPC .... A61G 5/125; A61H 3/04; A61H 2003/046; A61H 2003/043; A61H 2201/1635; A61H 2201/1633; A61H 2201/0192; A61H 2201/0107; A61H 2201/5097
See application file for complete search history.

(56) References Cited

U.S. PATENT DOCUMENTS 3,790,974 A * 2/1974 Johansson ..... A61G 5/14 5/83.1
3,914,808 A * 10/1975 Woods ..... A61G 7/1019 5/83.1
4,054,319 A * 10/1977 Fogg, Jr. ..... A61G 5/042 297/330
4,211,426 A * 7/1980 Motloch ..... A47D 13/04 280/87.041
4,249,774 A * 2/1981 Andreasson ..... A61G 5/14 297/311
4,545,616 A * 10/1985 Booth ..... A61G 5/1059 297/320
4,576,351 A 3/1986 Brink
5,167,435 A 12/1992 Aldi
5,224,717 A 7/1993 Lowen
5,265,689 A * 11/1993 Kauffmann ..... A61G 5/042 180/65.51
5,316,370 A 5/1994 Newman
5,509,673 A * 4/1996 Wu ..... A61G 5/023 280/250.1
5,676,388 A * 10/1997 Bertani ..... A61H 3/04 280/250.1
5,702,326 A * 12/1997 Renteria ..... A61H 3/04 135/67
5,772,226 A * 6/1998 Bobichon ..... A61G 5/14 180/907
6,125,957 A * 10/2000 Kauffmann ..... A61G 5/14 180/65.1
6,231,067 B1 * 5/2001 Johnson ..... A61G 5/14 180/65.1
6,619,681 B2 * 9/2003 Gutierrez ..... A61G 5/14 280/250.1
7,273,255 B2 * 9/2007 Nylander ..... A61G 5/1059 297/330
7,641,210 B2 * 1/2010 Babcock ..... A61G 5/022 280/246
2005/0179291 A1 8/2005 Brodeur
2007/0227787 A1 * 10/2007 Kuramoto ..... A61G 5/045 180/65.1
2010/0207354 A1 * 8/2010 Hunziker ..... A61G 5/14 280/304.1
2017/0209319 A1 7/2017 Fawcett et al.

FOREIGN PATENT DOCUMENTS

JP H0109960 A 4/1997
JP 2000-501964 2/2000
JP 2007-244817 A 9/2007
JP 2009227262 A 10/2009
JP 2013034780 A 2/2013
TW 200904391 A 2/2009

OTHER PUBLICATIONS

Extended European Search Report issued by the European Patent Office dated Sep. 17, 2018 in European Patent Application 15822239.8.
International Search Report and Written Opinion dated Oct. 1, 2015 for International Patent Application No. PCT/US2015/040036.
Examination Report No. 1 issued by the Australian Patent Office dated Sep. 7, 2017 in Australian Patent Application 2015290001.
Examination Report No. 2 issued by the Australian Patent Office dated Apr. 20, 2018 in Australian Patent Application 2015290001.
First Notification of Examiner's Opinion issued by the National Intellectual Property Administration of P.R.C dated Nov. 2, 2017 in Chinese Patent Application 2018092101931740.
Office Action issued by the Intellectual Property Office in ROC (Taiwan) Patent Application. No. 108111385 dated Nov. 11, 2019.
Office Action dated Apr. 11, 2019 in Japanese Patent Application No. 2017-502893.
International Search Report and Written Opinion dated Jun. 10, 2019 in International Patent Application No. PCT/US2019/024074.
First Examination Report issued by the Intellectual Property Office in India Patent Application. No. 201717005099 dated Dec. 31, 2019.
Office Action issued by the Israel Patent Office in Israel Patent Application. No. 250070 dated Apr. 7, 2020.
Decision of Rejection issued by the Japan Patent Office in Japan Patent Application. No. 250070 dated Mar. 17, 2020.

* cited by examiner

ELEVATING WALKER CHAIR

CROSS-REFERENCE TO RELATED APPLICATION

This International Patent Application claims priority to U.S. Provisional Patent Application Ser. No. 62/024,006, filed Jul. 14, 2014, entitled: ELEVATING WALKER CHAIR, the entirety of which is incorporated herein by reference as it set forth herein in it's entirety.

BACKGROUND OF THE INVENTION

Conventional devices to assist individuals having mobility difficulties fall into two broad categories—walkers and wheelchairs—plus several intermediate combinations that may additionally help occupants rise up and ambulate.

Walker devices, such as the standard "Zimmer Frame," add support and stability but involve the user's hands and arms to an extent that precludes carrying or manipulating anything while moving. Four-wheeled walkers may also include seats, but they can't be employed unless the user stops and turns around.

Walkers are slow and isolating, and inherently dangerous when set aside in order sit down.

Most wheelchair (and powered wheelchair) users remain interminably seated, at the expense of muscular, circulatory, and cardiac well-being.

'Elevating' wheelchairs employ large motors to raise strapped-in occupants to a standing position and some can power them from place to place while upright, but without reinforcing ambulatory abilities or requiring any muscular contribution Another intermediary category of assistive devices includes 'stand-up' walkers, which partly lift occupants up and down and encourage them to walk.

Unfortunately, existing stand-up walkers inhibit user interactions with the world—either by having large structures ahead and rear entry, or with clumsily uncomfortable folding seats, procedures and restraints. And the users must still lift a significant percentage of body weight with legs and arms in order to rise from a seated to a standing position.

What is missing is a means for individuals with ambulatory limitations to sit and stand at will, to walk with a natural gait, and to safely and easily interact with their environment—to cook, clean, do the wash, get dressed and transport themselves—all at the altitude desired, and always with at least a small component of their own energy and former athleticism.

SUMMARY OF THE INVENTION

Disclosed is an elevating walker chair for people with limited mobility resulting from compromised musculature, coordination or balance, or for able bodied individuals that must perform tasks for which assistance is desired. The elevating walker chair provides a novel hybrid of riding and walking that encourages ones normal gait yet prevents falling. An illustrative embodiment of the invention allows a user to stroll, stride and coast and relatively easily sit down and rise up—all in a functionally equipoised and weightless condition—without having to exit the device, and with hands free as needed for other purposes.

DESCRIPTION OF THE DRAWINGS

The following figures depict illustrative embodiments of the invention.

DETAILED DESCRIPTION OF THE INVENTION

Figure 1:
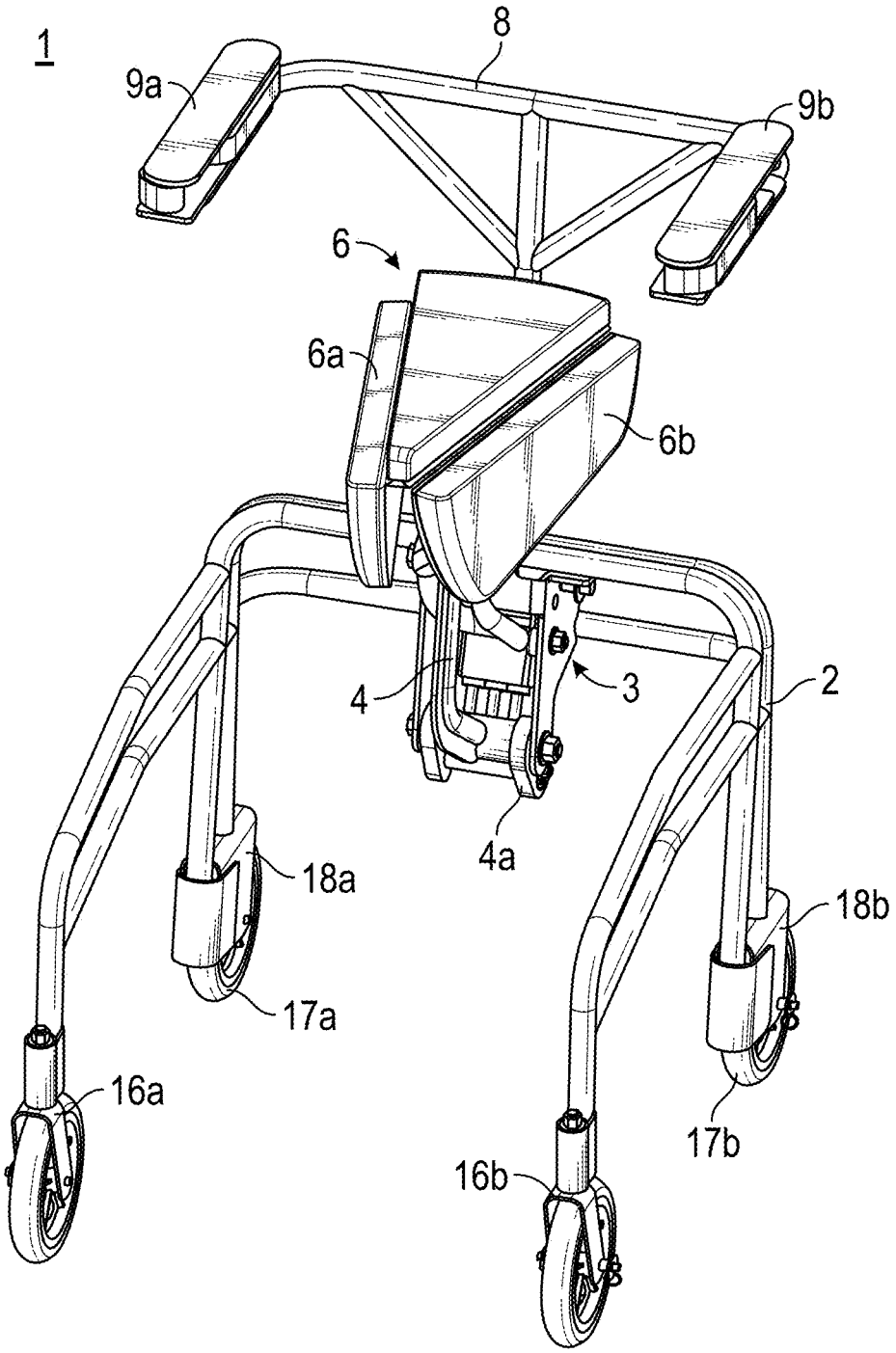
FIG. 1 depicts a full perspective view of an illustrative embodiment of the elevating striding chair of the invention.

FIG. 1 depicts a perspective view of an elevating walker chair 1 according to an illustrative embodiment of the invention, seen in its elevated 'walking' position, including wheeled frame 2 attached to lifting chassis 3, components of which resiliently pivot lifting extension frame 4*a* downward and attached lifting strut 4 upward, with a force calibrated to permit folding saddle/seat 6 to equipoise its occupant by counterbalancing the occupant's weight to provide an essentially "weightless" condition, as the frame rises toward the upward limit of its parallelogram-supported excursion.

Armrest/seat back frame 8 is attached to seat mounting block 7 (shown in FIG. 10), and supports armrest assemblies 9*a*, 9*b*. Left and right folding seat wings 6*a*, 6*b* are shown folded downward in the 'saddle' position, which is suitable for elevated seating. Armrests 6*a,b* are shown in a retracted position, but can be optionally forward deployed, which can aid in supporting the torso in a position for walking. Sufficient clearance of the seat with respect to the ground frame 2, including to the sides of the seat and below is provided to permit a walker's legs and feet to stride to the rear or to engage the ground sideways if desired.

Because embodiments of the invention permit ambulation without frontal obstructions as found in traditional walkers, a user will retain forward access at various heights, including a standing height, to sinks, stoves, closets, etc. and will be able to maneuver in between.

Figure 2A:
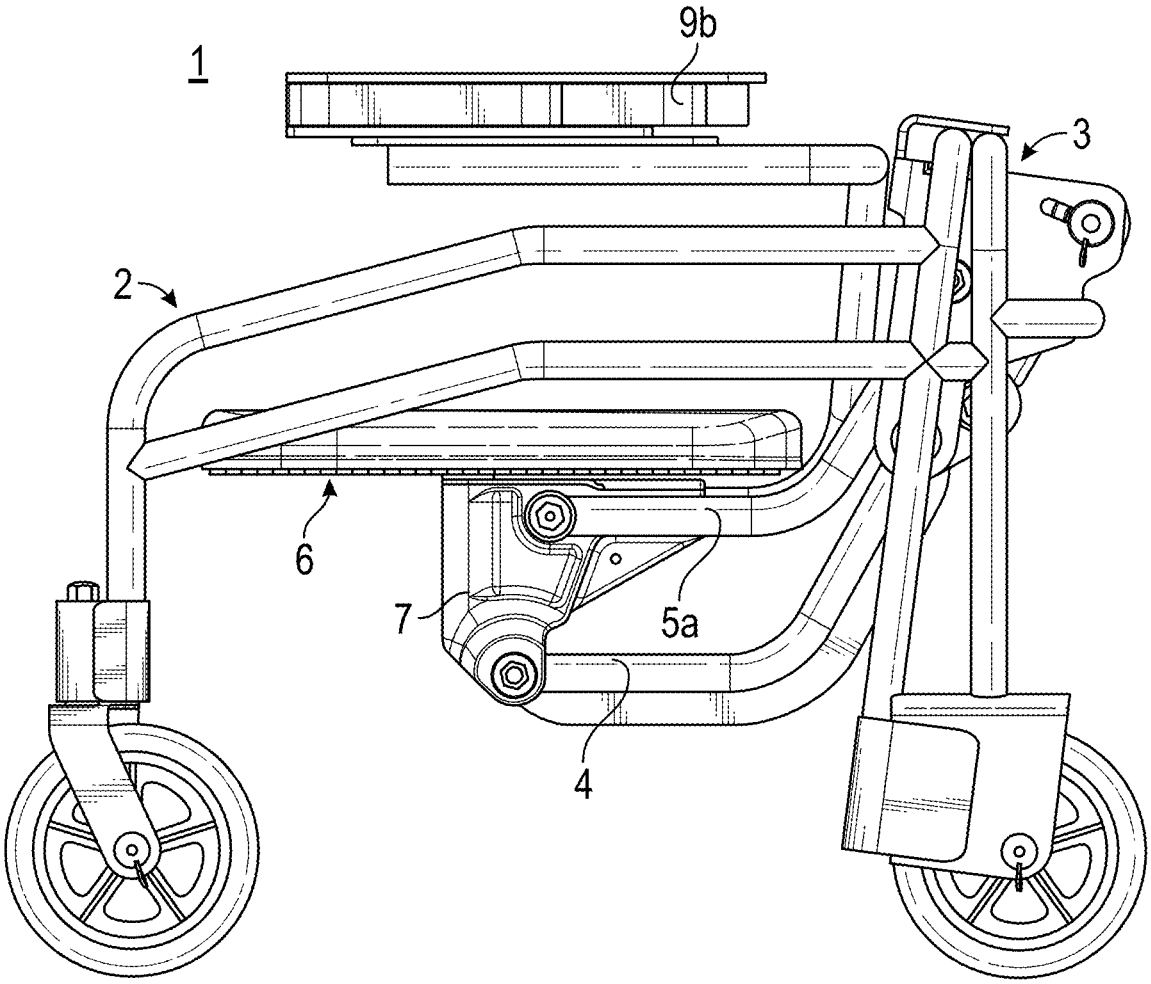
FIGS. 2*a-b* depict side elevations of the chair 1 showing a saddle/seat unfolded to form a chair in the lowered position and with wings folded to form a saddle in the in the raised position.
Figure 11A:
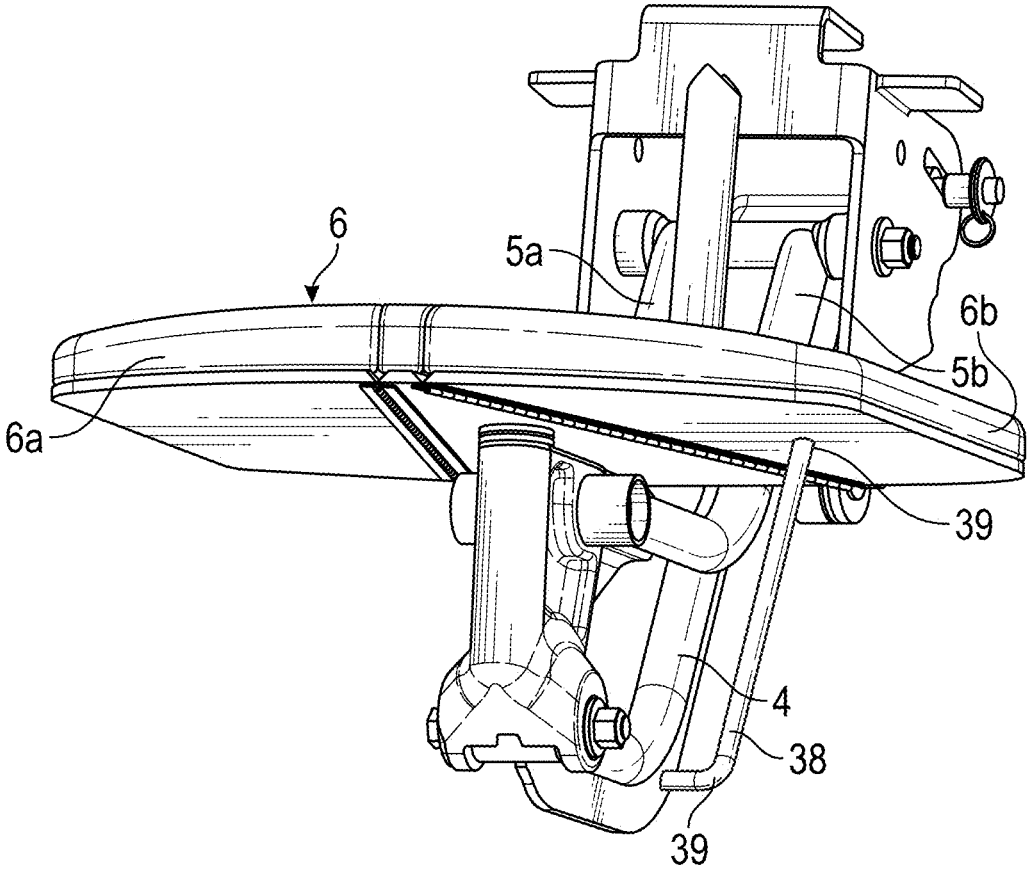
FIGS. 11*a,b* depict a saddle/seat and show how a seat wing is swung upward by a wing deployment strut into seat mode as the saddle descends.

FIGS. 2*a,b* depict side elevations of elevating walking chair 1. FIG. 2*a* shows saddle/seat 6 unfolded to form a chair, and at its lowest, chair-height position. The chair height is modified by a parallelogram apparatus formed by seat mounting block 7, lower parallelogram lifting strut 4, upper parallelogram struts 5*a,b* and lifting chassis 3. In this position, elevating walking chair 1 functions as a conventional chair, which can optionally include an upholstered seat back and padding for armrests 9*a,b*. Seat frame 2 can be formed of any appropriately strong material including carbon fiber, curved aluminum box beam, etc. Note that lifting strut 4 and parallelogram struts 5*a,b* are bent in the illustrative embodiments of the invention depicted in the drawings. The bends allow the seat to occupy space that would not otherwise be available, thereby increasing the seat's excursion distance as compared to an embodiment wherein the struts are straight. FIG. 11*a* illustrates the position of seat 6 within curved parallelogram struts 5*a,b*. The bends allow the back edge of the seat to clear the struts when the seat is lowered. Curved lifting strut 4 can also enlarge the available space for seat 6. Although lifting strut 4 and parallelogram struts 5*a,b* are curved they are configured to perform in a manner analogous to configurations with straight parallelogram sides.

Figure 2B:
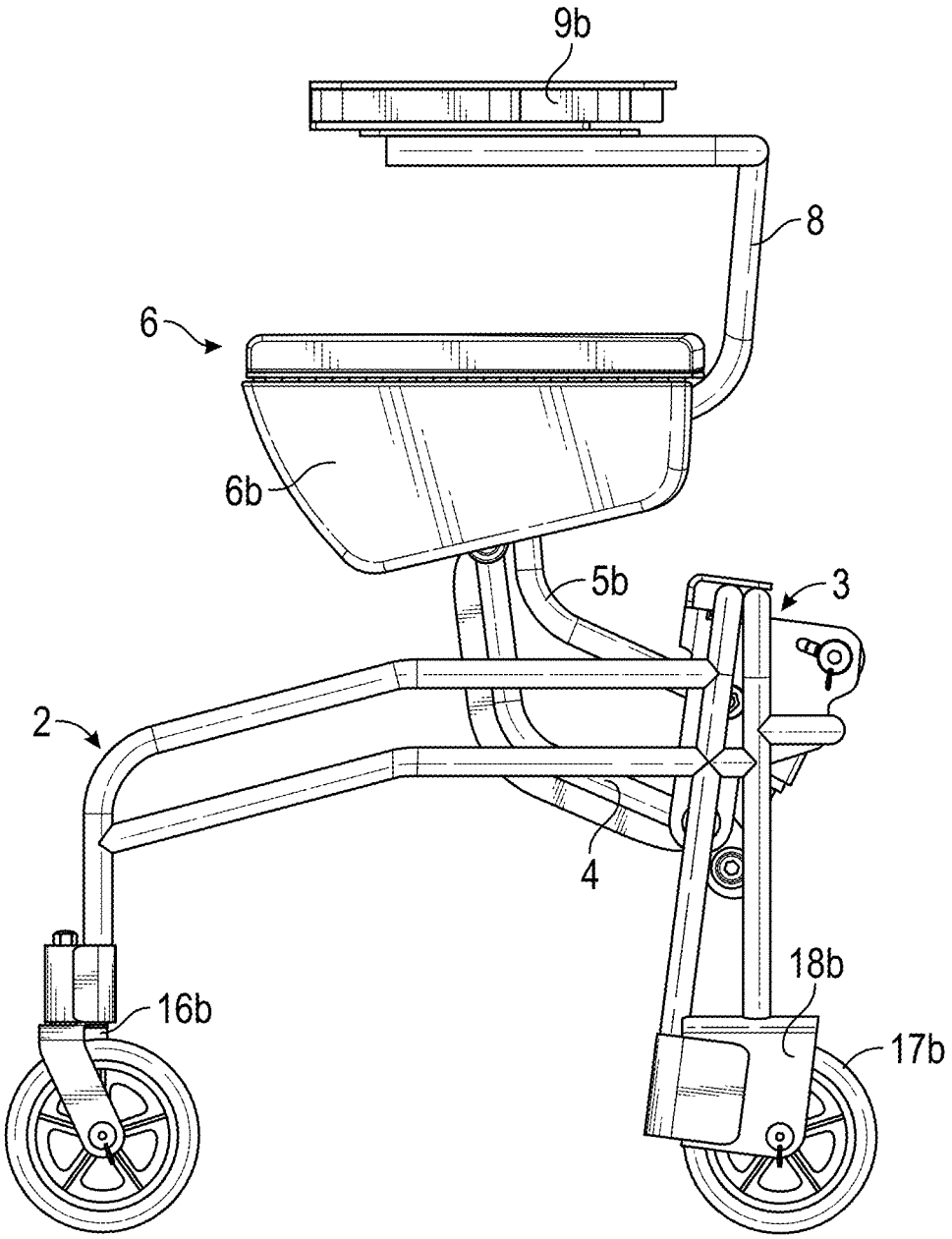

FIG. 2*b* shows seat 6 swung up to a selected elevated position for ambulation. Seat wings 6*a,b* are folded down to form tapered saddle 6. Seat frame 8, which is attach to seat mounting block 7, supports armrest assemblies 9*a,b*. Rear wheels 17*a,b* are preferably of fixed orientation, i.e. non-swivalable, and are attached to motor mounting plates 18*a,b*, which can be adapted to receive conventional small, self-contained motor and battery sets (not shown), to optionally supplement foot and leg power as needed, and assist steering maneuvers by applying incremental forward and reverse torques to the rear wheels. A preferably wireless joystick (not shown) can be attached to the top surface of armrest 9*a* or 9*b*, to add slight forward, rearward or turning motive power as needed, to just the degree required to supplement an individual's abilities.

Figure 3A:
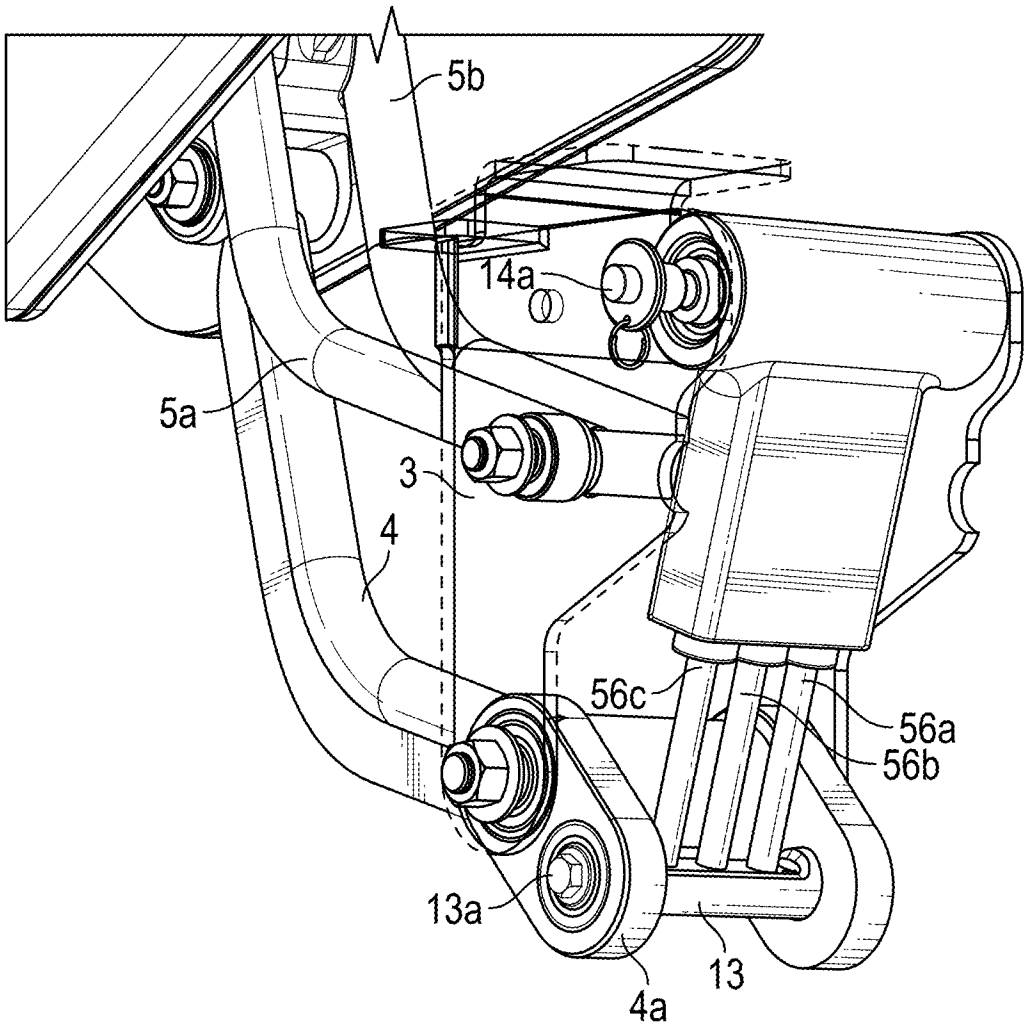
FIGS. 3*a-b* depict perspective views of the lifting chassis 3 of the invention including parallelogram struts, plus a close, transparent rendering of the resilient lifting cassette.

FIG. 3*a* depicts a perspective view of lifting chassis 3 that includes a lifting cassette 14 that houses resilient power units 15*a,b,c* (shown in FIG. 3*b*) whose extendable shafts 56*a,b,c* are seen engaging receiver bar 13. Receiver bar 13 pivots on axle 13*a* within the end of lifting extension frame 4*a*, which is connected to and pivots lower parallelogram lifting strut 4 upward to elevate saddle/seat 6 and its human payload.

Figure 3B:
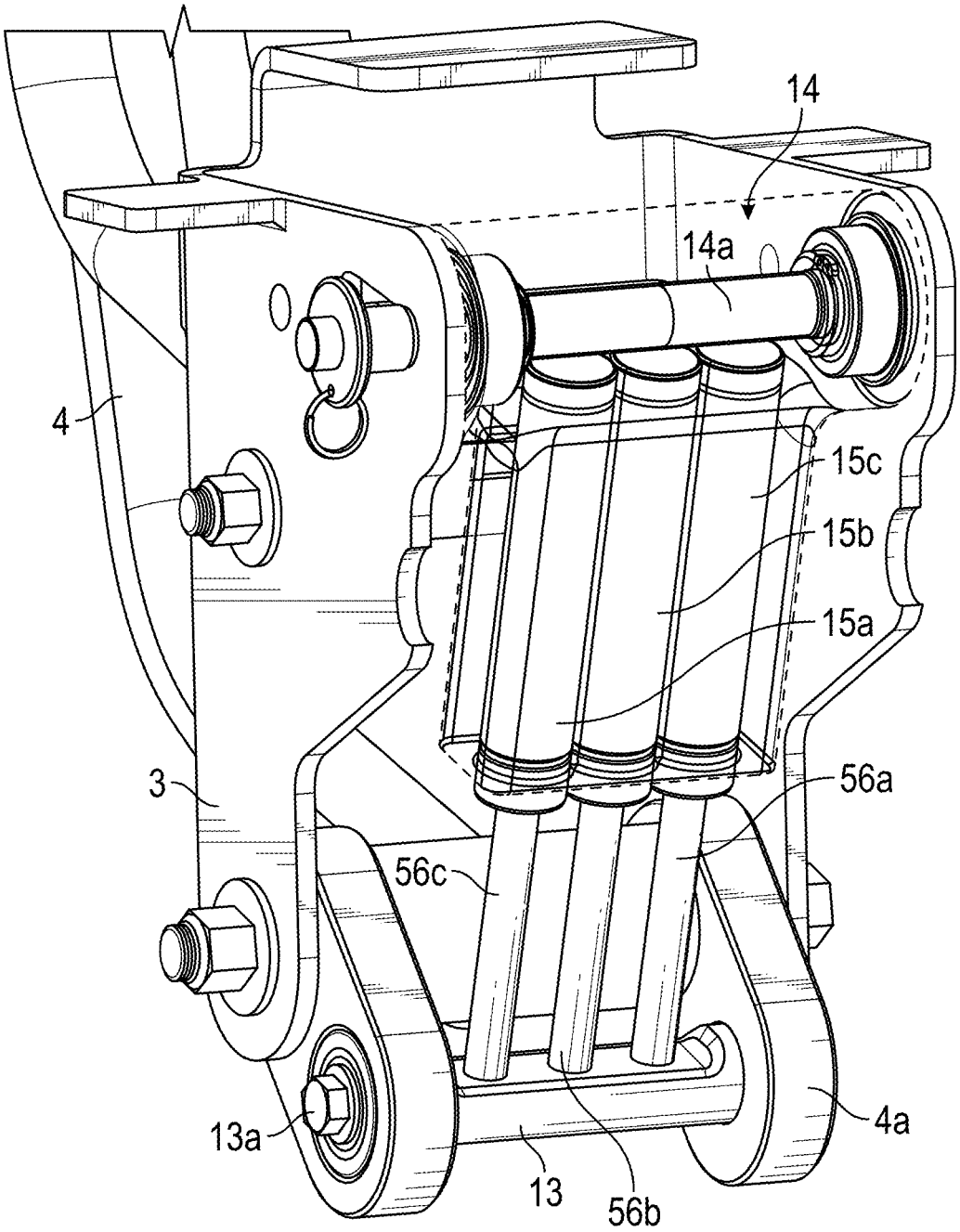

FIG. 3*b* includes a transparent rendering of resilient lifting cassette 14, showing its internally-mounted resilient power units 15*a,b,c*—such as small, powerful gas springs, for example. The resilient power units can be selected in a combination that will closely equipoise the weight of the seat occupant. Cassette 14 pivots within chassis 3 around axle 14*a* so that its internal resilient units (such as gas springs) can remain extendably in contact with receiver 13. Since the illustrated gas springs 15*a,b,c* provide a powerful compression force, they bias extension frame 4*a* strongly downward, in the manner of the 'heavy kid' on the short end of a seesaw, who can counterbalance the 'light kid' on his much longer end. In fact, since the effective pivot-to-pivot length of strut 4 in this embodiment is about 6.9 times the pivot length of extension 4*a*, then the sum of the forces exerted by a given set of gas springs 15*a,b,c* can be divided by that ratio to indicate the approximate weight of a person they would support. For a closer approximation, the weight of seat 6 must be included, minus approximately half the separate weight of the persons legs—but in practice it is found that a person's weight plus about 10 lbs provides a good indication of the net gas spring lifting power that will successfully 'float' the person in an equipoised condition that lets them rise up and sit down as if in "zero gravity."

The chart below illustrates the net lifting value of some available gas spring type resilient power units, as may be illustratively employed in embodiments of the invention. It can be seen that the most powerful gas spring in this list will actually lift a net payload of nearly 100 lbs (at the forward payload end of the lifting parallelogram) as each cassette is pressured to provide up to 691 lbs of extending force.

Even though outer gas springs (15*a* and 15*c*) should be selected to be identical (to avoid drastically off-center loads on receiver bar 13 and extension frame 4*a*), it is clear that combinations of available net lifting values can easily be specified to approximately 'float' nearly anyone weighing from 80 lbs to 300 lbs.

Combinations of resilient power component can include for example, a single central spring, two identical outer springs, or a combination of one inner and two identical outer springs. Other numbers of individual power component can be used; however, it is preferable to avoid off-centered forces. In an illustrative embodiment of the invention, combinations are selected to equal the rider's weight plus about 10 lbs:

The chart below shows parameters of illustrative gas springs. The gross lift is that which the spring inherently possesses. The net lift is the gross lift divided by 6.9, which is an illustrative ratio between the length of lifting strut 4 and extension frame 4*a*. In this illustration, all springs have a shaft excursion of 3.15 inches.

| Net Lift (lbs) | Gross Lift (lbs) |
|---|---|
| 6 | 40 |
| 12 | 81 |
| 16 | 94 |
| 18 | 121 |
| 23 | 157 |
| 25 | 173 |
| 32 | 220 |
| 42 | 292 |

-continued

| Net Lift (lbs) | Gross Lift (lbs) |
|---|---|
| 50 | 346 |
| 75 | 519 |
| 100 | 690 |

Springs or other resilient power units of different powers typically have different outer diameters or other dimensions. To easily switch resilient power units, a standard connection or other accommodation is present in the lifting cassette, and an adaptor, such as a standard diameter sleeve is provided to render all resilient power units of a form compatible with resilient lifting cassette 14.

Figure 4A:
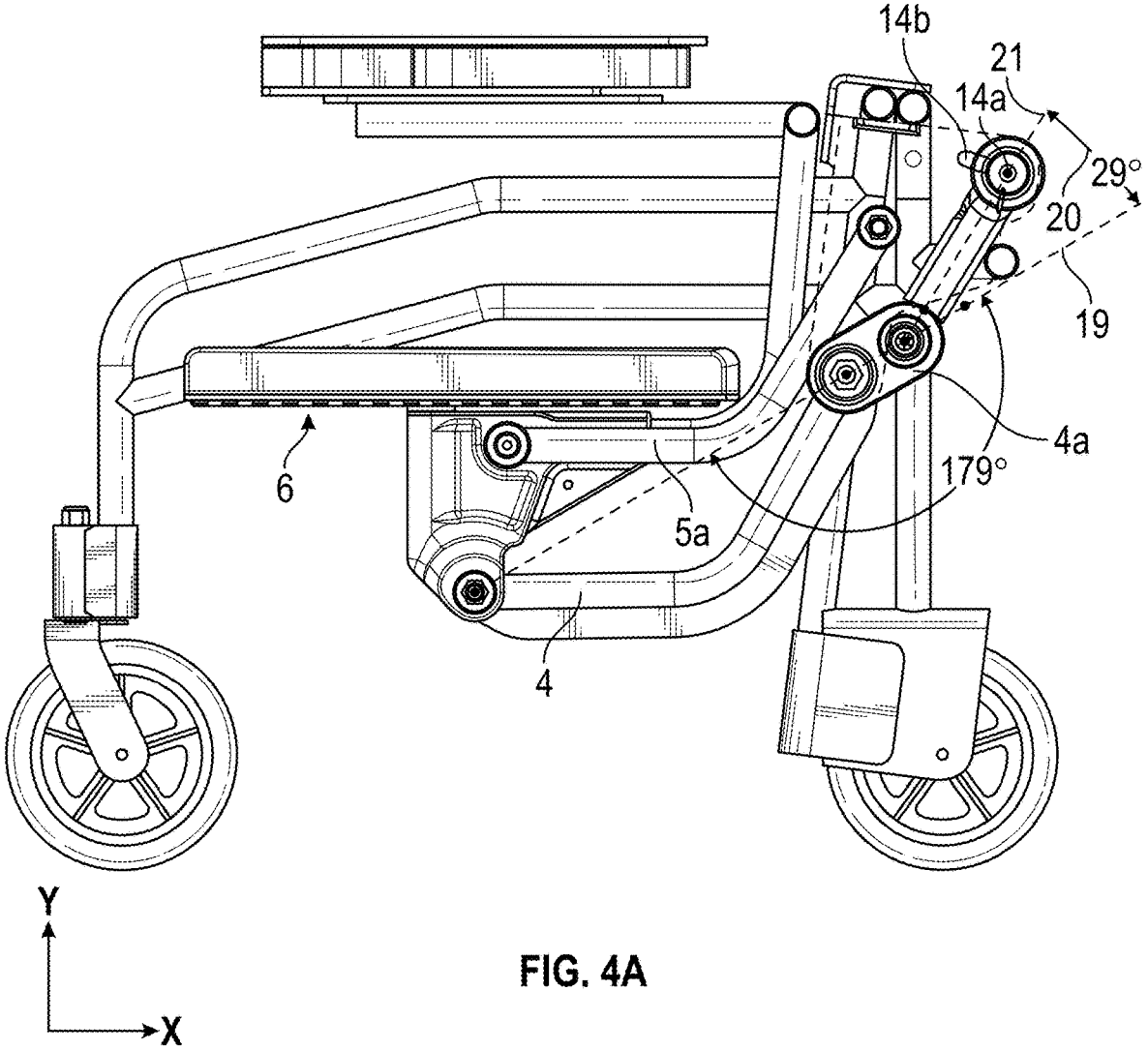
FIGS. 4*a-b* depict side elevations of two alternate positions of a cassette axle along a slot, generally associated with differences in payload lifting performance.

FIGS. 4*a,b* depict side elevations illustrating two alternate positions of cassette axle 14*a* along slot 14*b* that yield differences in payload lifting performance. The term "iso-elasticity" refers to the exemplary consistency of lifting force, from lowest to highest excursion, obtained by parallelogram arms designed to float 'Steadicam®' camera stabilizer payloads.' Iso-elasticity was considered to be desirable for lifting human beings so they don't need muscle power to rise from a seated to a standing position, but unlike camera payloads, sitting humans, rising to become saddle-borne humans, weigh varying amounts throughout this transition. In practice, though most of a person's weight bears initially on the seat, the remainder (approximately half the weight of legs and feet) actually bears on the floor—and this proportion varies as someone prepares to stand up. As he or she leans forward to rise, significantly more leg weight is transferred from seat to floor. The result is that to actually 'equipoise' or effectively 'zero-g' a person throughout this transition, the amount of lift provided must likewise vary, and it is found that a consistent, 'iso-elastic' lift may rise too rapidly at first and then too slowly as the saddle-born occupant nears a standing posture.

FIG. 4*a* illustrates the optimal angle between lifting extension centerline 19 and the force applied along cassette centerline 21. The angle is achieved in this illustrative embodiment of the invention when cassette axle 14*a* is slid the "rear" of adjustable cassette positioning slot 14*b*. The resultant 29° lifting angle, in this embodiment yields a 'super-iso-elastic' lifting force curve that would cause an inert payload to drop excessively at the bottom of travel and rise too energetically at maximum height, but that is preferable for lifting up humans whose legs remain in contact with the floor. An illustrative angle range is from about 27° to about 31°. The resulting 'super-iso-elasticity' yields appropriate lifting force for two reasons: First it is powering a limited arcuate excursion at a high 'see-saw' ratio of force to payload weight. And second, the momentary extending force of the selected gas springs along cassette centerline 21 is applied in a direction optimally to lifting extension centerline angle 19 throughout its travel. The initial 29° force angle is inefficient for lifting and lets the occupant remain seated until he or she leans forward, thus transferring sufficient leg/foot weight to the ground to launch the parallelogram upward. The angle of the force applied to the short lever arm, designated as lifting extension frame 4*a*, reaches 119° just as saddle 6 reaches its maximum upward position. At this extension, gas springs 15*a,b,c* exert only about 0.6 of their original force, but at a relatively efficient angle to extension centerline 19, which would cause an inert payload to bump hard against the upper stops. However once the occupant's legs approach vertical and a larger percentage of his or her weight rests on the saddle, the lifting performance can more effectively equipoise the human payload.

Figure 4B:
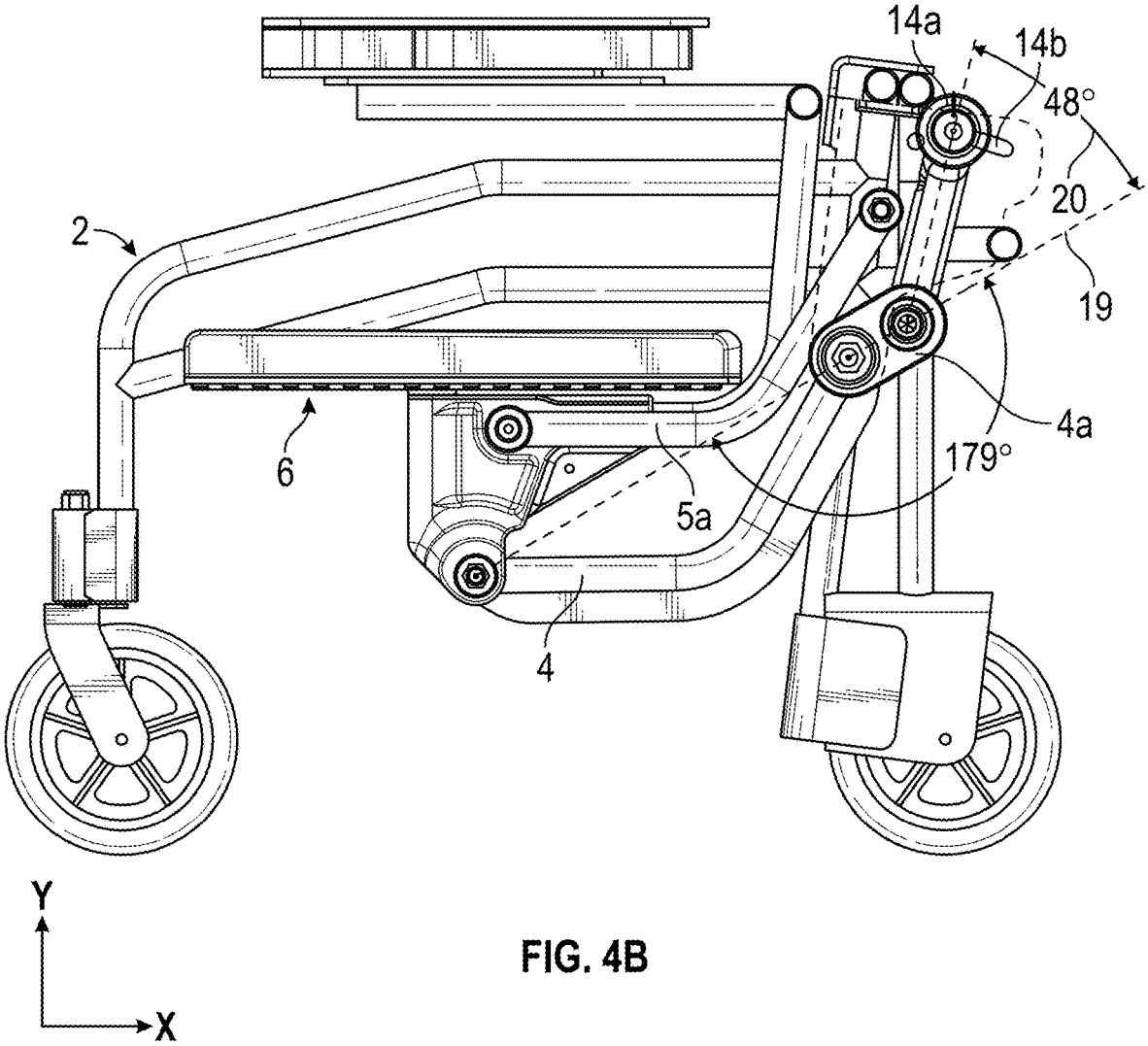

FIG. 4*b*, by contrast, illustrates the optimal 'iso-elastic' lifting angle of 48° which, in this illustrative embodiment of the invention, would evenly lift an inert non-human payload. However, the dynamically varying human payload, as described above, would find difficulty getting himself or herself down to seat height. Particularly since a portion of descending inertia is in practice diverted to activate seat deployment (as shown in FIGS. 11*a,b*). And our human payload would also have difficulty reaching maximum height, since the diminishing proportion of leg weight reaching the ground would effectively make him or her heavier. Non-obviously therefore, though iso-elastic lift is achievable, it is not optimal for the very particular requirements of human equipoising according to the invention.

An illustrative lifting angle range for a more iso-elastic excursion is about 46° to about 50°. Generally, as lifting angles increase above 48°, the payload will require externally added upward or downward force to reach respectively, the top or the bottom of travel, whereas a lifting angle less than 48° may cause the payload to require added upward force to rise from the lowest position, and downward force to descend from maximum height.

Figure 5A:
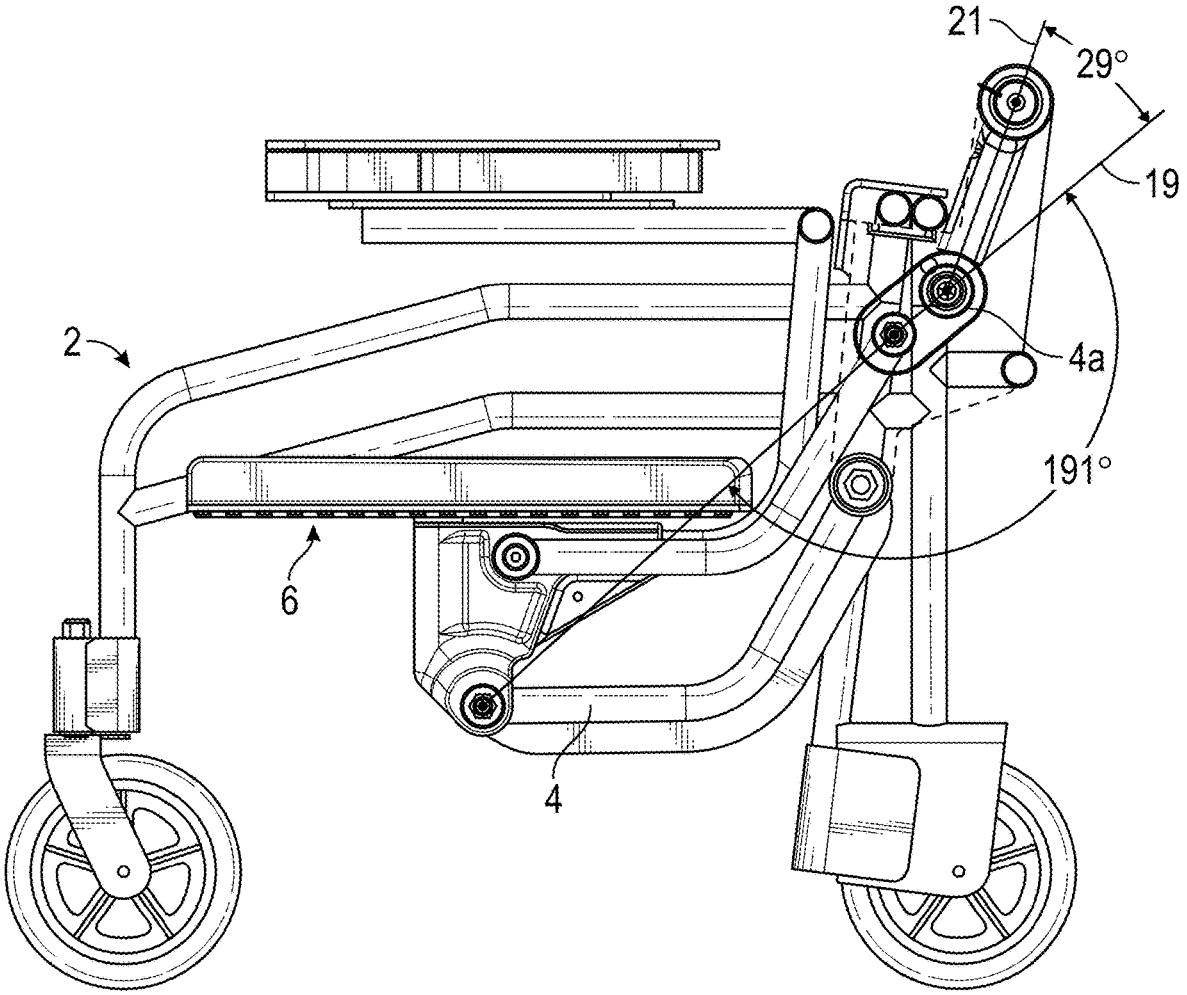
FIGS. 5*a-b* depict side elevations of various selected mounting angles for lifting the extension frame to yield potentially identical lifting performance if lifting-frame angle to cassette centerline angle is consistent.

FIGS. 5*a,b* depict side elevations illustrating that various other selected mounting angles for lifting extension frame 4*a* can yield similar or identical lifting performance if the angle between resilient cassette centerline 21 and lifting-frame centerline 19 is, in each case, arranged to be 29° when seat 6 is at its lowest excursion. FIG. 5*a* illustrates a structural variation according to an illustrative embodiment of the invention, in which lifting extension frame 4*a* is attached to upper parallelogram struts 5*a,b* instead of to lower parallelogram lifting strut 4 as in previous figures. Note that lifting performance can be similar or identical, and thus similarly suitable for human occupants, because the angle between lifting frame centerline 19 and cassette centerline 21 has been constructed to again be 29° or there about. This arrangement can be advantageous for several reasons, including that it keeps the lifting components higher up behind the backrest, and thus, more out of the way of rearward foot and leg excursions when striding and coasting.

Figure 5B:
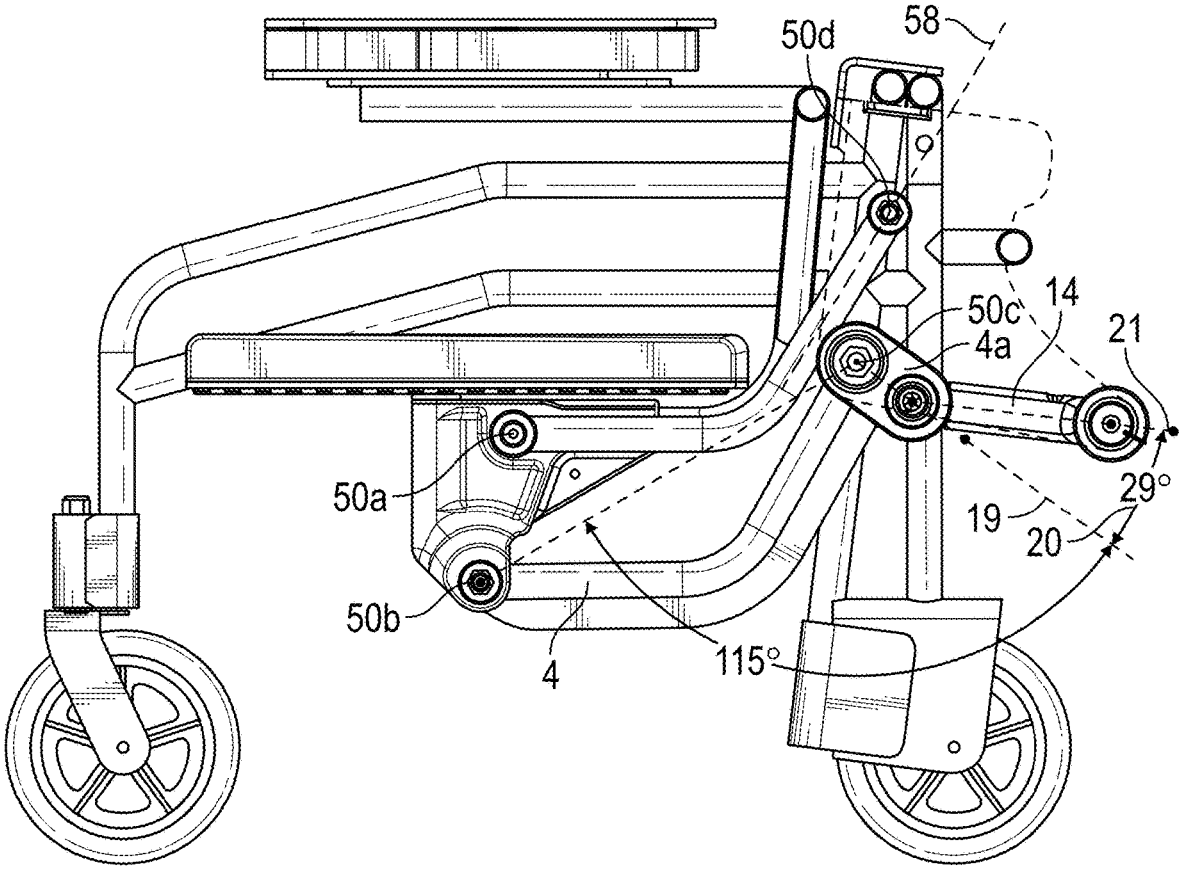

FIG. 5*b* depicts another illustrative variation in the angular location of the lifting apparatus. In this view, the lifting extension centerline 19 is at nearly right angles to the longitudinal centerline 58 of the portion of lifting strut 4 to which lifting strut 4 attaches, and resilient lifting cassette 14 is sticking straight out to the rear. Note, however, that cassette centerline angle 21 is again at a 29° angle to lifting frame centerline 19, and so this version, though merely illustrative and not particularly functional, would deliver similarly or identically appropriate lifting performance for its human payload.

As shown in FIGS. 5*a,b*, extension frame 4*a* can be rotated to any desirable angle about the pivot center at its attachment to lifting strut 4, which is illustrated at an angle of 191 degrees for the FIG. 5*a* configuration, and 115 degrees for the FIG. 5*b* configuration. Rotation of extension frame 4*a* can position lifting cassette 14 as desired either inside or outside of the parallelogram defined by pivots 50*a,b,c,d*.

The lifting unit that includes lifting cassette 14, extension frame 4*a* and the associated parallelogram structure, can be used in other applications in which parallelogram lifting structures can be employed, i.e. not merely in the elevating lifting chair described herein. In other words, the lifting units described herein are in essence stand-alone mechanisms that can be incorporated into other devices that require the lifting function the apparatus provides. The sides of the parallelograms of these lifting units can be bent, such as lifting strut 4 and parallelogram struts 11*a,b*, or may be straight as in traditional parallelogram links. Bends in the parallelogram sides can be designed to allow the optimal excursion necessary for a particular application. The lifting units may be mounted on a stand, a fixed or movable structure or even to a vest that a user would wear.

Figure 6A:
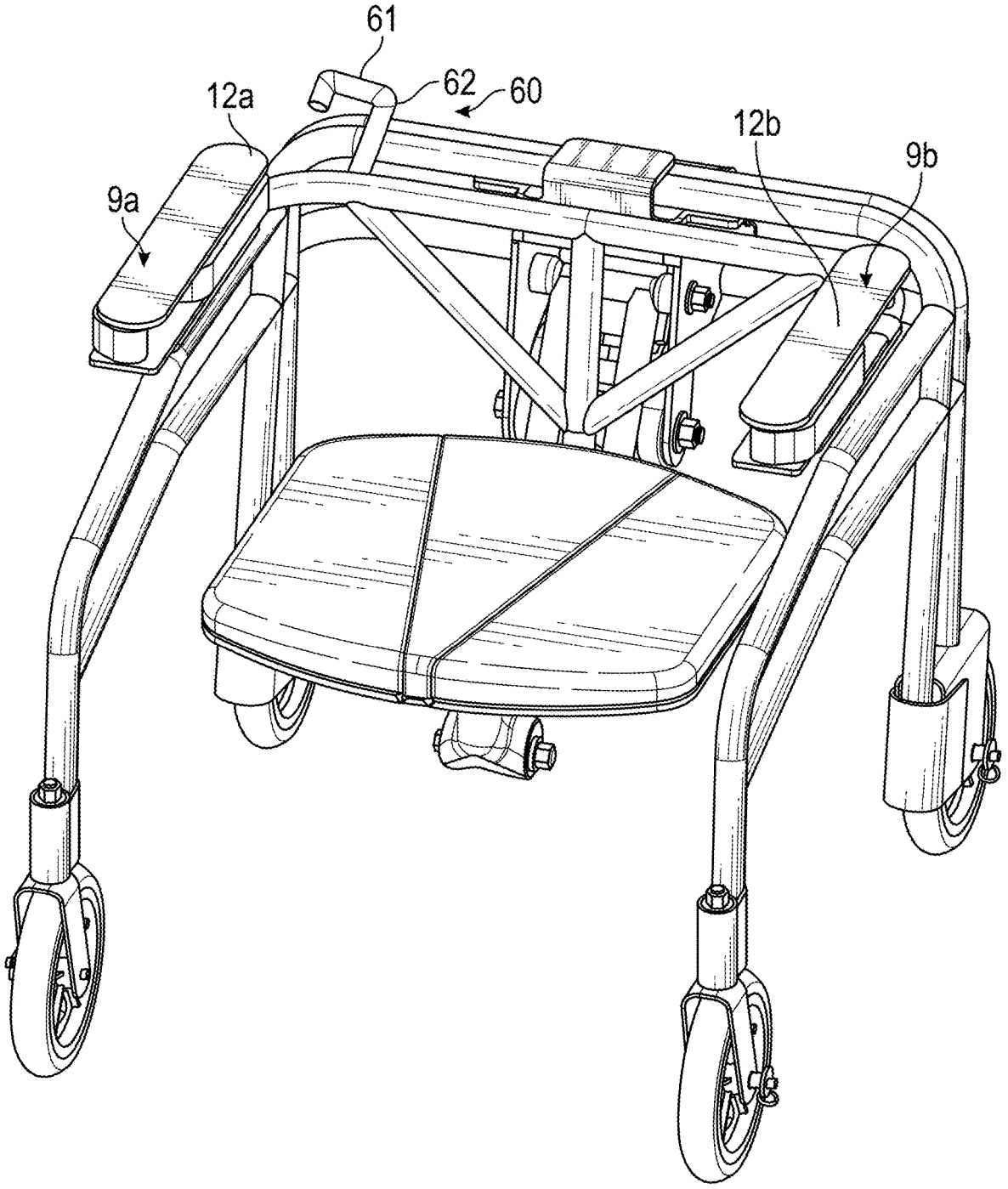
FIGS. 6*a-c* depict deployment positions for left/right armrest assemblies that lock and unlock the seat height and rear wheels, as the user transitions from seat mode, upward to saddle mode and ambulation.
Figure 6B:
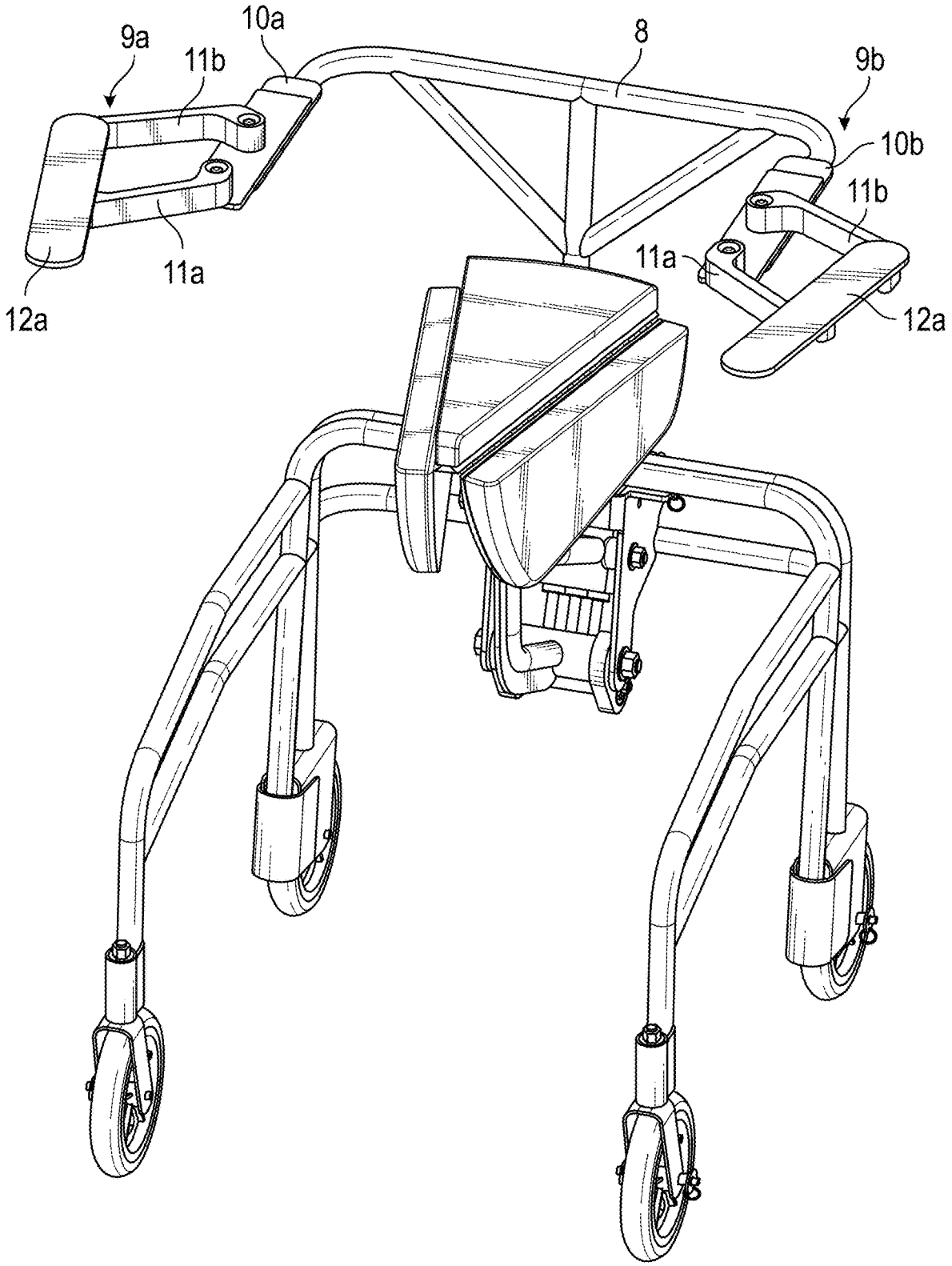
Figure 6C:
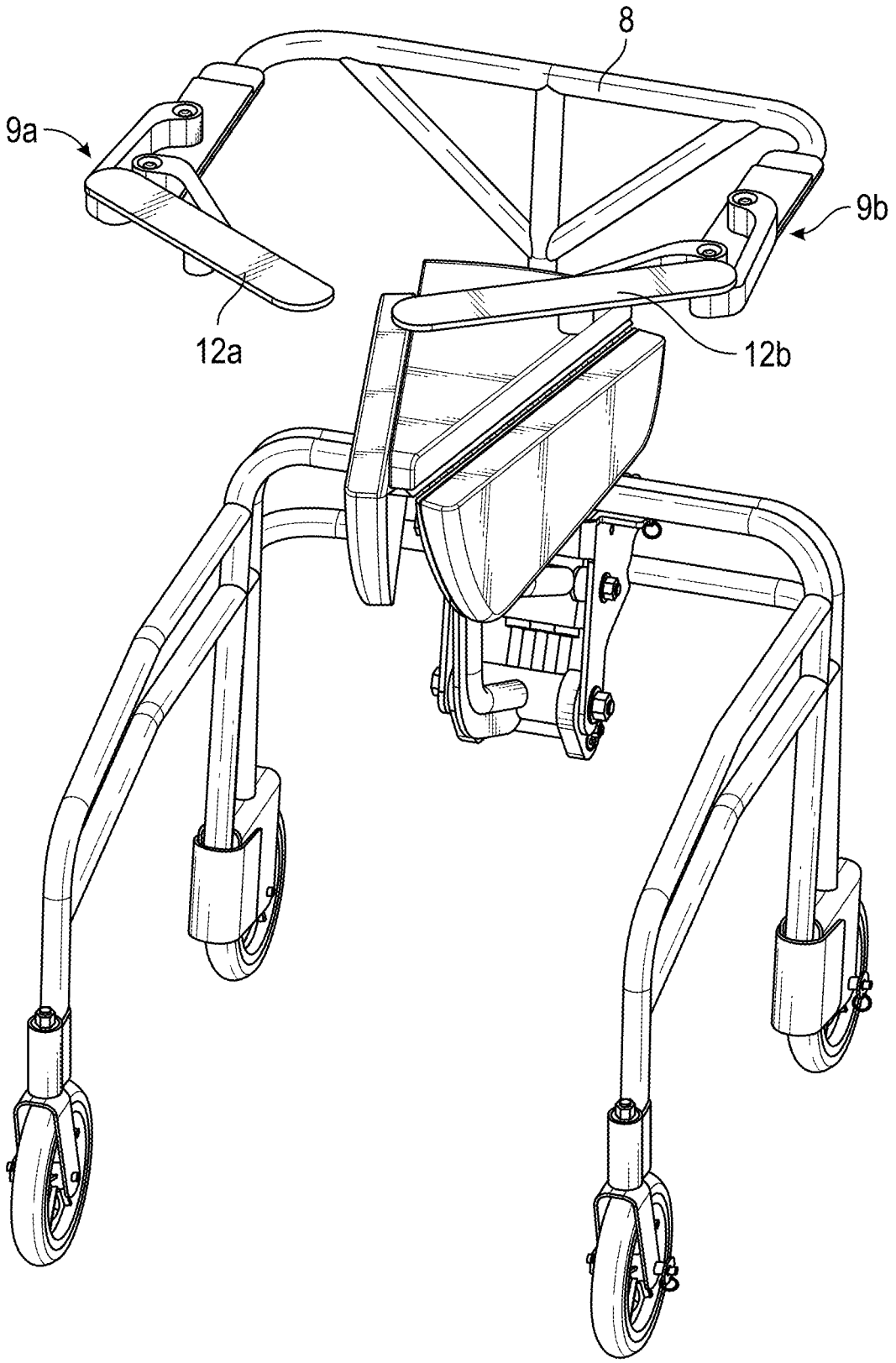
Figure 9A:
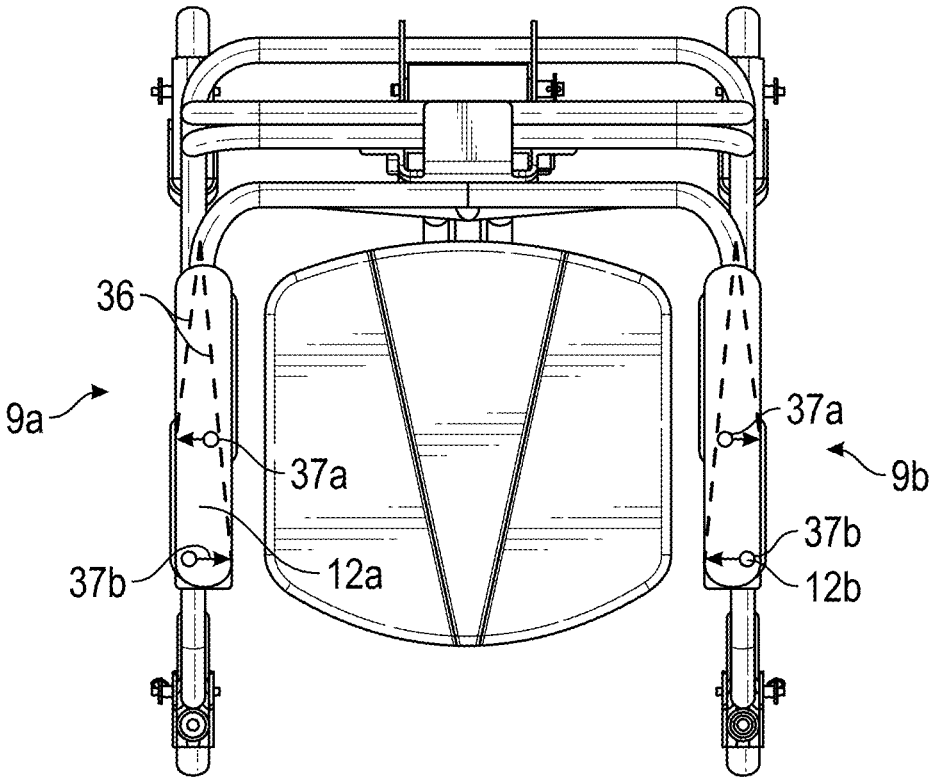
FIGS. 9*a-c* depict an illustrative arm rest with cam or crankshaft axles that actuate braking and lift-locking functions through sequential deployment positions.

FIGS. 6*a,b,c* depict deployment positions for left/right armrest assemblies 9*a,b* that can be adapted to appropriately control the locking and unlocking of the seat height and rear wheels 17*ab*, as the user transitions from seat mode, upward to saddle mode and ambulation. FIG. 6*a* depicts the chair mode with armrests 9*a,b* fully retracted to serve as conventional armrests. FIG. 6*b* shows armrests 9*a,b* partially deployed. Fore/aft parallelogram deployment struts 11*a,b* are of uneven length and thus will begin to alter the angle of cover plates 12*a,b* with respect to armrest support plates 18*a,b* as they are swung out to the side. This armrest position is appropriate for 'boarding' the elevating walker chair. FIG. 6*c* illustrates the ultimate forward deployment of armrests 9*a,b*, in which the uneven parallelogram linkages swing cover plates 12*ab* back inward to form appropriate restraining and armrest surfaces appropriate for ambulation. As can be seen in FIGS. 9*a,b,c*, these three armrest positions will be employed to actuate the separate locking/unlocking of seat height and the rear wheel brakes in an illustrative embodiment of the invention.

Figure 7A:
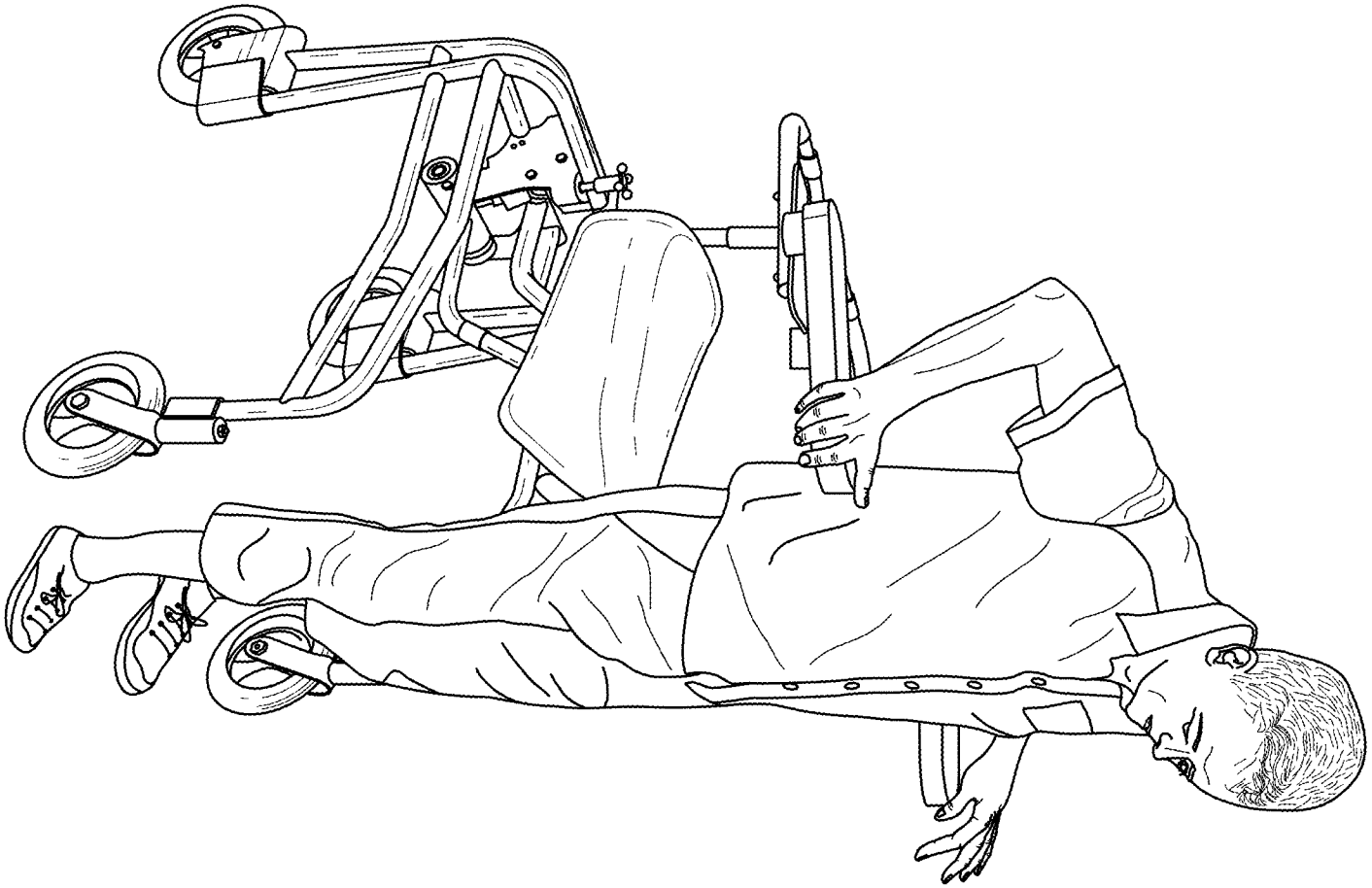
FIGS. 7*a-d* depict progressive engagement by a user with the actuating armrest control functions of the invention, as he boards and effects a downward transition to seated height.
Figure 7B:
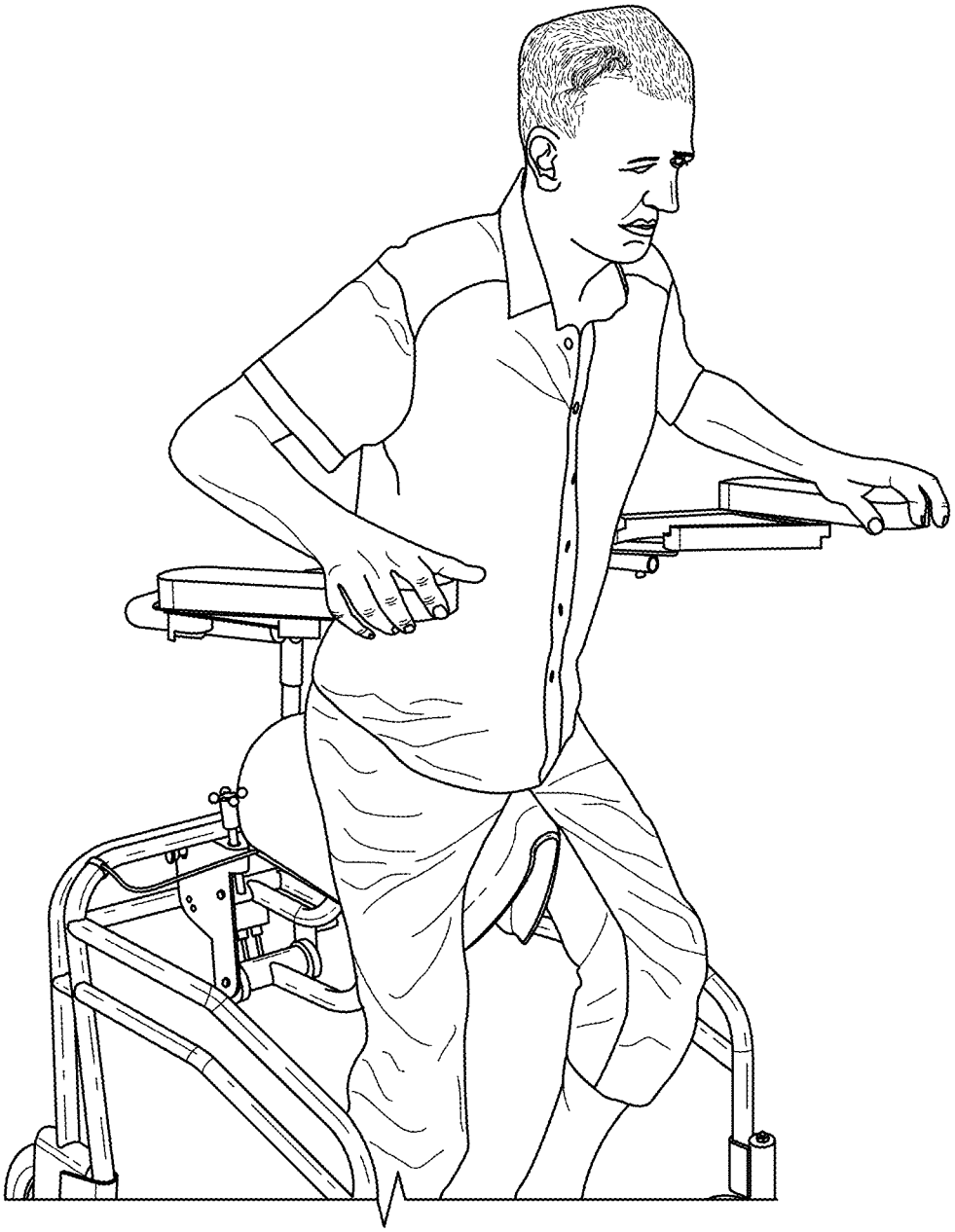
Figure 7C:
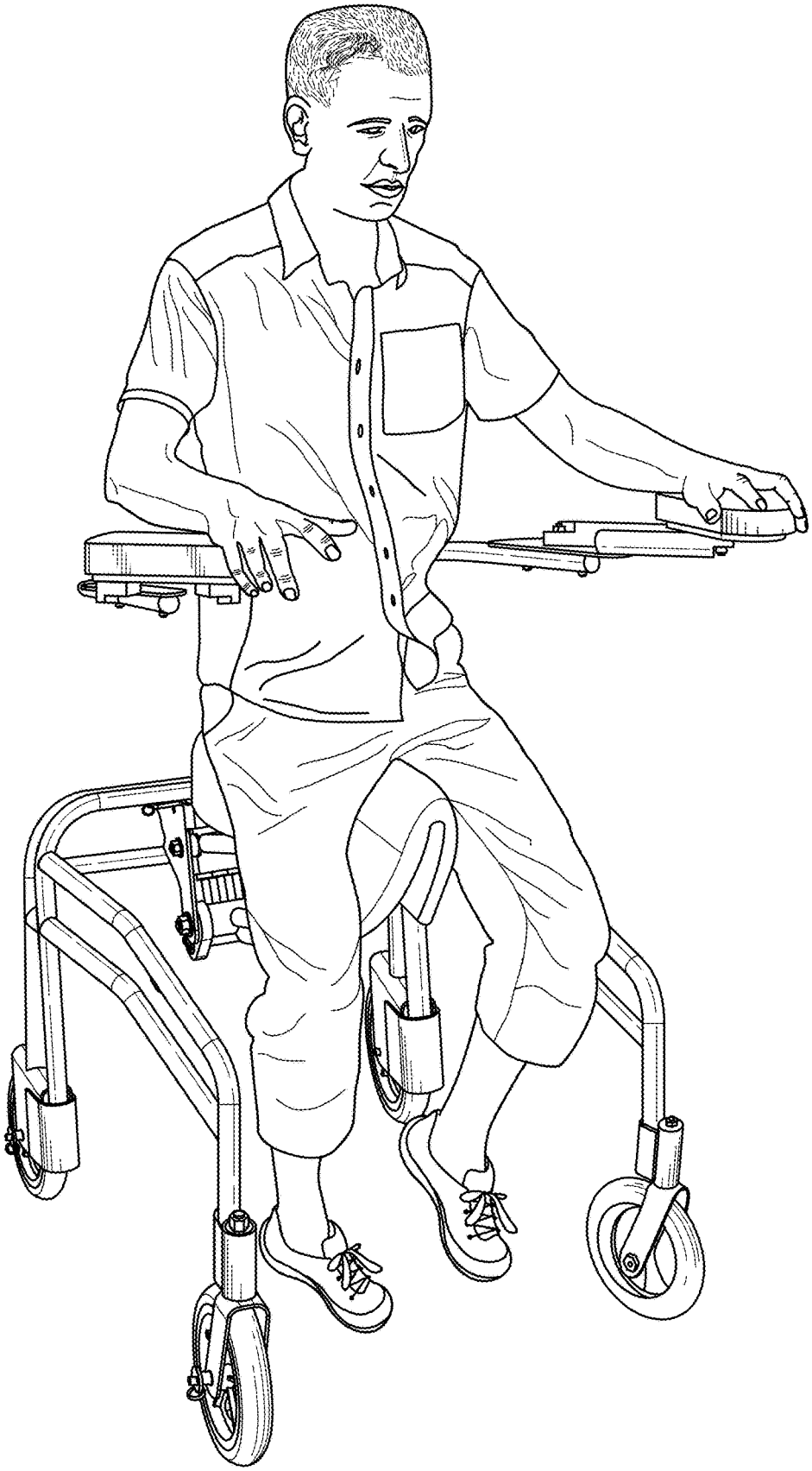
Figure 7D:
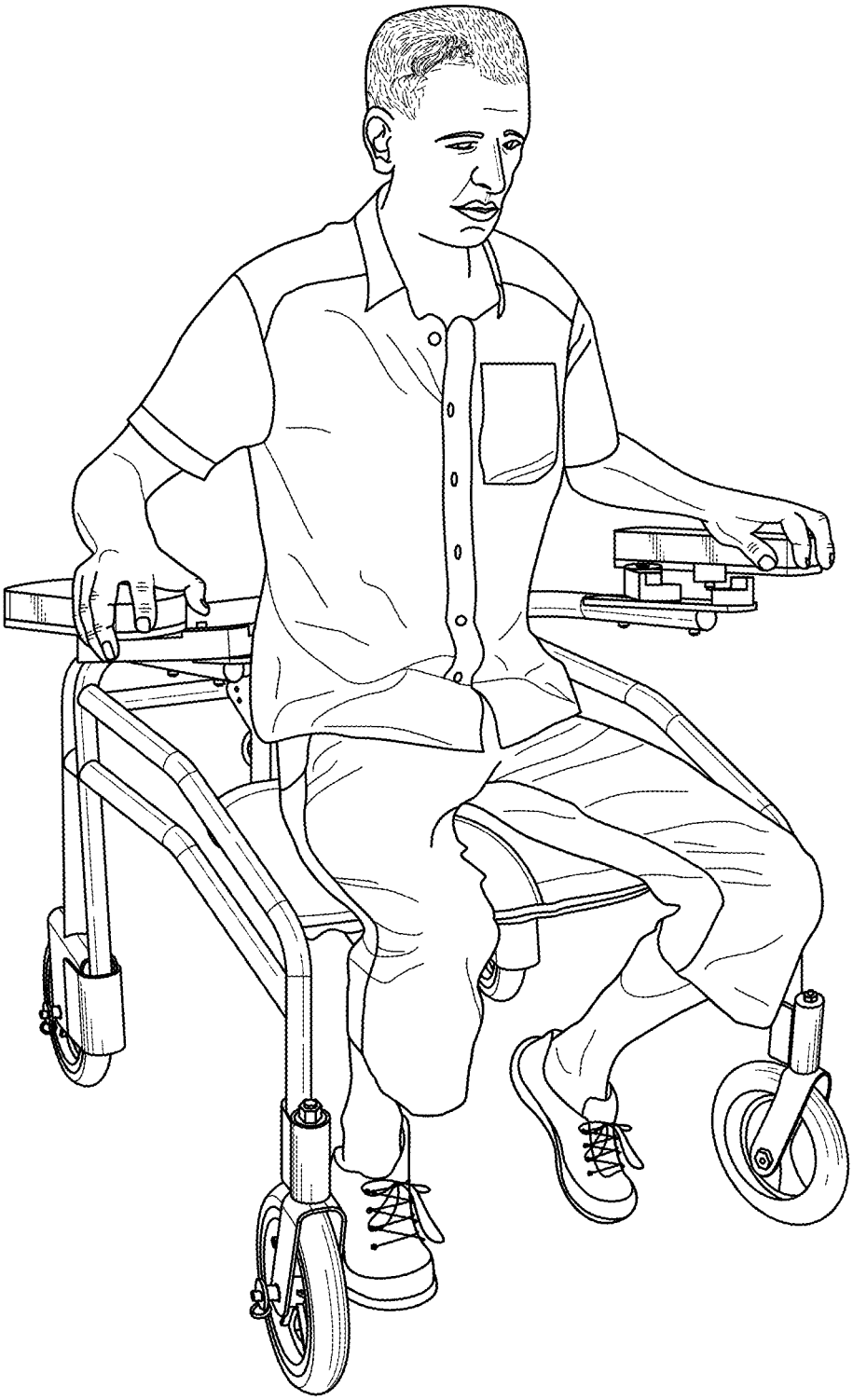

FIGS. 7*a,b,c,d* depicts progressive engagement by a user with the novel actuating armrest control functions of an elevating walking chair, as he boards and effects a downward transition to seated height. In FIG. 7*a*, the user grasps the armrests in extended position (which preferably has locked the rear wheel brakes) and approaches the saddle. In FIG. 7*b* he transfers his weight to the saddle and preferably fastens his seatbelt (not shown). The extended armrest position also preferably unlocks seat height. In FIG. 7*c* the user can be seen leaning slightly back to cause the seat to descend, while supporting all but a few pounds of his weight. In FIG. 7*d* the user has descended to chair height, the seat wings have automatically deployed outward and the user pulls the armrests back toward their conventional sitting position, preferably actuating the seat height lock and freeing the brakes, (by means illustrated in FIGS. 9*a,b,c*).

Figure 8:
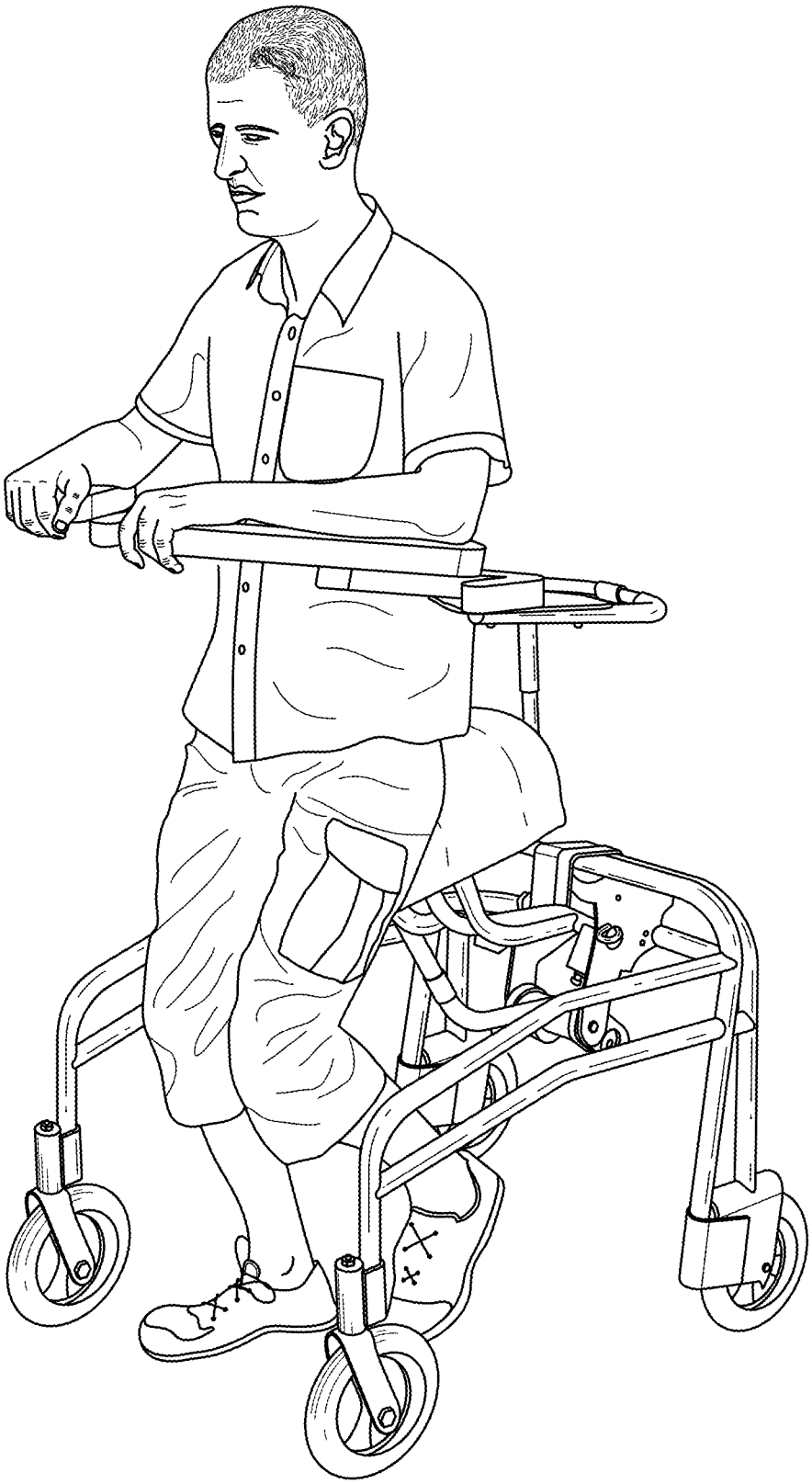
FIG. 8 depicts the armrests being employed to stabilize and partly support an ambulating user, riding on folding saddle/seat and displaying a posture for walking, striding and/or coasting.

FIG. 8 depicts armrests 9*a,b* swung forward to a position appropriate for forward ambulation, enclosing the user, providing armrest surfaces that will facilitate ambulation, and if available in the embodiment, actuating the seat height lock, releasing the rear brakes. The user is shown in an appropriate posture for conventional walking. According to the user's level of fitness and ability, he or she may elect to lean further forward, transfer a bit more body weight to the armrests and stride with somewhat larger steps, coasting in between, and with feet and legs extending ground contact further to the rear.

An illustrative range of height variations, for example between the seated position of FIG. 7*d* and the striding position of FIG. 8, is about 18 inches to about 34 inches.

FIG. 17 shows right-hand actuating armrest assembly 9*a* depicted in perspective with transparent top cover plate 12*a*, to illustrate armrest positions yielded by excursions of fore/aft parallelogram struts 11*a,b*, which are uneven in length, and their respective actuating functions. FIG. 17*a* shows the position of the afore-mentioned components when the arm assembly is in its retracted position. FIG. 17*b* shows armrest assembly 9*a* easing sideways (preferably beginning to actuate right-rear wheel brake). FIG. 17*c* drawing shows armrest 9*a* fully extended sideways (preferably unlocking the lifting function and implementing full braking). FIG. 17*d* shows armrest 9*a* in its forward-most position so top cover plate extends at least partially in front of a user, thereby enclosing, stabilizing and supporting ambulating activity, and preferably locking lift and actuating the release of the right-hand wheel brake. These functions will be further illustrated in FIGS. 9*a,b,c*.

FIGS. 9*a,b,c* depict armrest 9*a* showing an illustrative mechanism for actuating braking and lift-locking functions throughout sequential armrest deployment positions shown. Crankshaft axles 37*a,b* are fixed to fore/aft armrest deployment struts 11*a,b* so they rotate in unison. The arrows shown extending from crankshaft axles 37*a,b* in FIGS. 9*a,b,c* indicate the direction of attached arms associated with the crankshaft axles. The crankshaft arms are adapted to pull actuating wires 36, indicated by dotted lines on both armrests. The dotted lines show the path of the central wire-ends, which can be for example, from four conventionally-terminated bicycle-type brake cables (not shown). Actuated by crankshaft axle 37*a*, one end of wires 36 on each armrest are preferably adapted to conventionally actuate and release its respective-side rear wheel brake. The other end of wires 36 on each side, are driven by 180 degree crankshaft axles 37*b* in opposing directions, which can also be employed via bike cables (not shown), to activate one of two redundant seat-height locks (not shown). The seat height locks may comprise conventional disc brakes or hydraulic locking cylinder assemblies, among other conventional braking and restraining options, preferably acting to restrain both upward and downward excursions of the lifting parallelogram of the elevating walker chair.

Figure 9B:
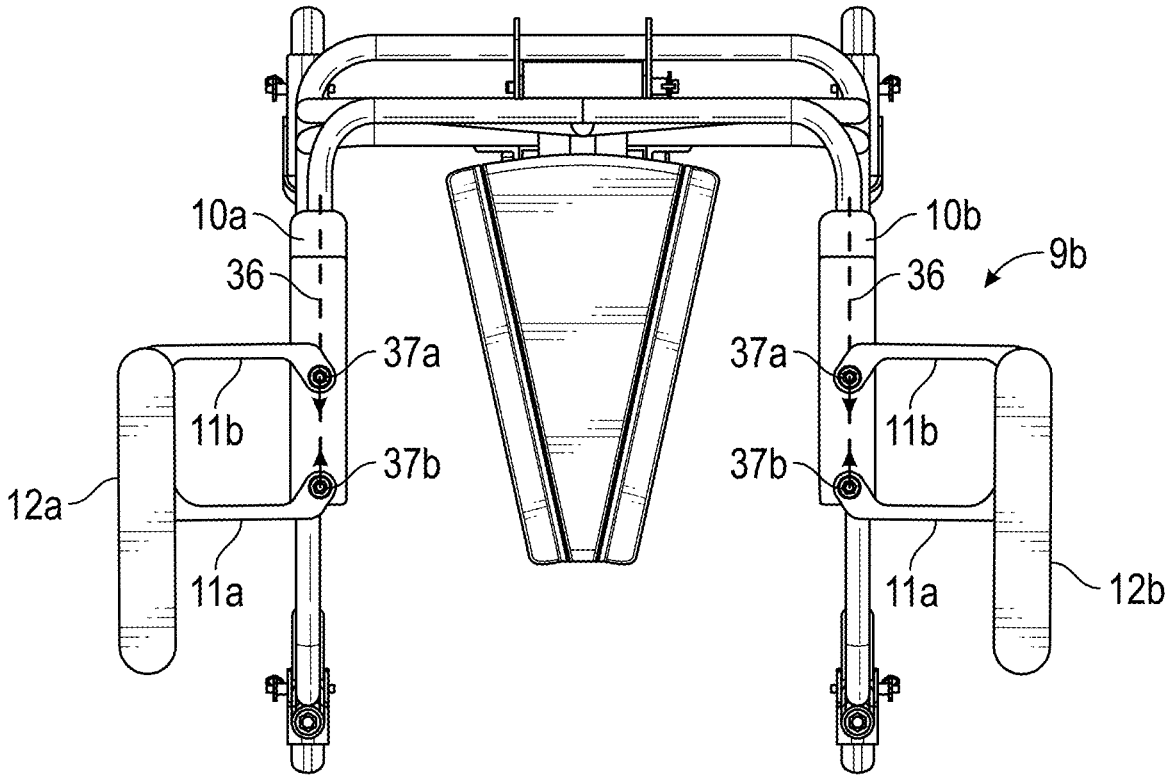
Figure 9C:
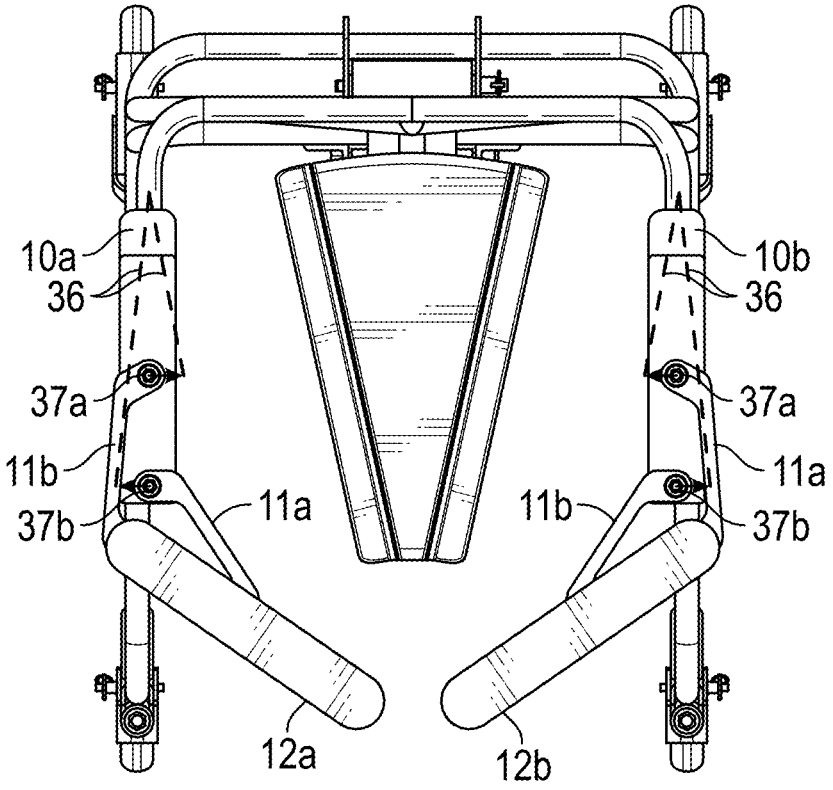

FIG. 9*a* shows armrest assemblies 9*a,b* in their rearward seated position. Crankshaft arms associated with crankshaft axles 37*a* on both armrests are directed outward (indicated by arrows), with their dotted line brake-cables 36 adjusted to cause respective left/right wheel brakes to be released. Forward crankshafts arms associated with crankshaft axles 37*b* on each side are inwardly directed, and their brake-type cables adjusted to cause the seat height to be locked. FIG. 9*b* shows armrest cover plates 12*a,b* swung outward and crankshaft arms (represented by arrows) fixedly associated with crankshaft axles 37*a,b* on both armrests respectively rotated 90° as shown. Both left and right crankshaft arms have swung forward and therefore caused ends of brake wires 36 to be extended and respective left/right wheel brakes firmly engaged. Note also that respective left/right wheel braking can thus be independently controlled by its same-side armrest position. This permits independent use of momentary slight wheel braking to retard progress of that respective left or right wheel and assist steering during ambulation. Also on left and right armrests 9*a,b*, crankshaft axles 37*b* are shown now swung to the rear, releasing their respective, redundantly dual seat-height brakes (not shown). Note that seat-height unlocking can also be independently actuated for a different reason—so that either armrest, in either seated or ambulating positions (FIGS. 9*a* and 9*c*, respectively) can effectively stop the seat from rising or falling; and both armrests must be positioned in the extended-to-the-side position shown here to release seat height lock, so that when boarding the saddle, or rising from a seated position, or merely selecting a new intermediate seat position such as 'bar-stool' height, seat/saddle 6 is free to raise and lower the equipoised occupant with minimal effort. FIG. 9*c* shows the positions of actuating crankshaft arms associated with crankshaft axles 37*ab* when both armrests are swung forward into the ambulating position. Note that crankshaft arms associated with crankshaft axles 37*a* are now inward, releasing their respective wheel-brake cables. Crankshaft arms associate with crankshaft axles 37*b* are respectively outward, engaging their individual seat-height locks so that ambulation is accomplished without having the saddle sink down if both feet are momentarily off the floor during, for example, coasting, or if relaxing in a high stationary position, such as at bar-stool height, with both feet on optional footrests (not shown). Note that the uneven-parallelogram deployment of the armrests is initiated by appropriately arcuate arm motions that mimic the arcuate excursion of parallelogram struts 11*ab*.

Figure 10:
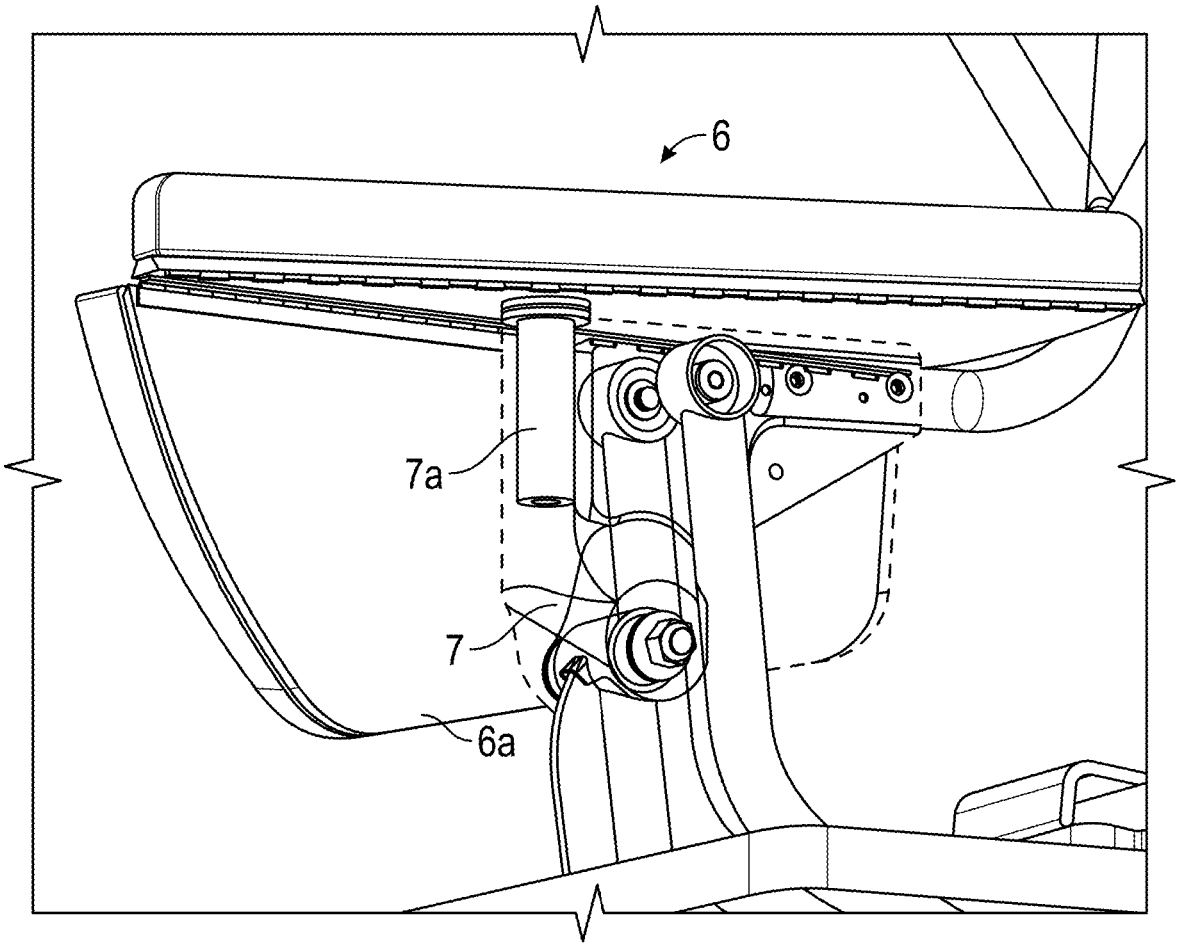
FIG. 10 depicts a folding seat/saddle assembly with a wing and seat mounting block showing how a seat mounting post facilitates limited dynamic side-to-side swiveling of the seat/saddle in order to provide a path for rearwardly striding legs.
Figure 18A:
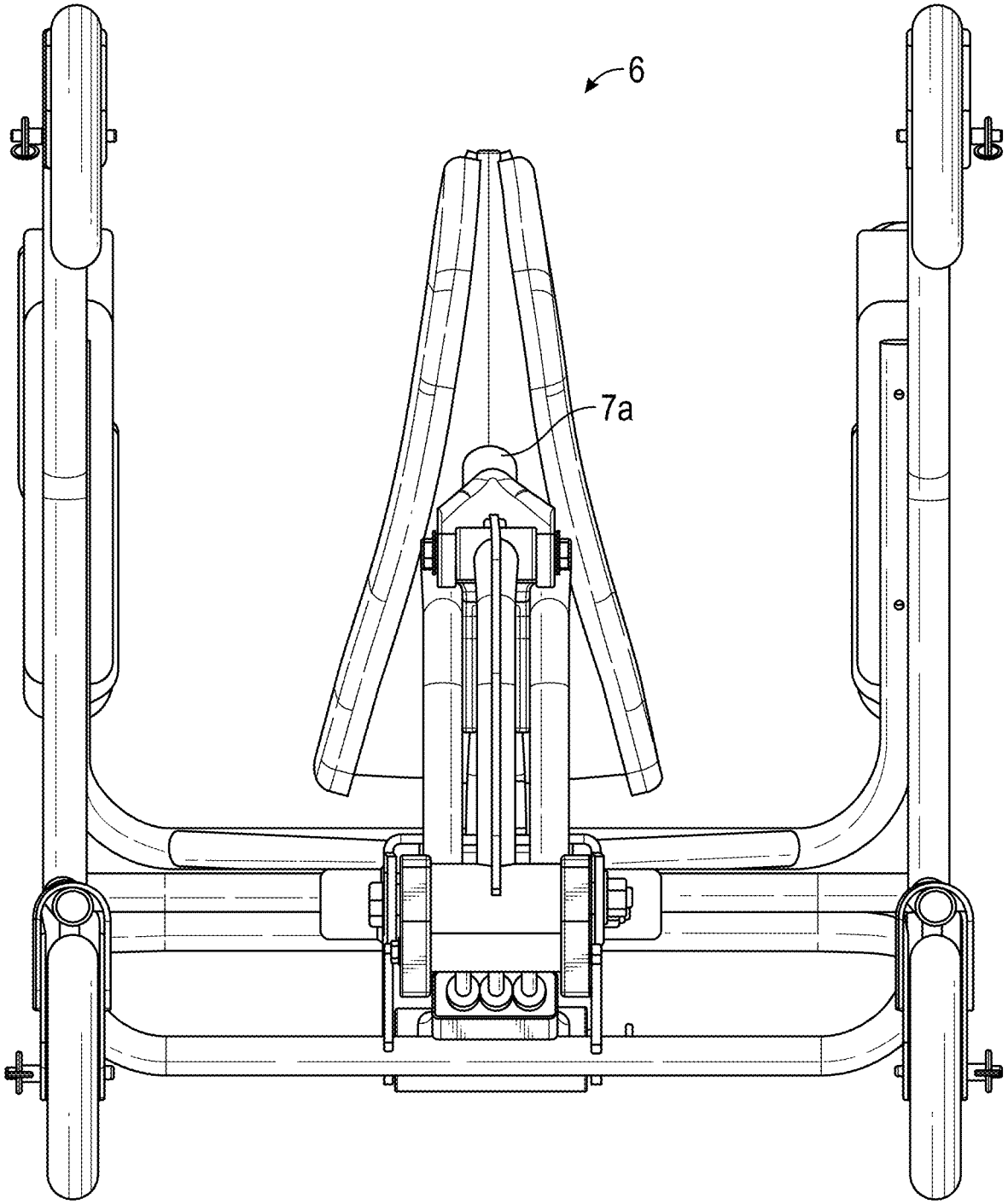
FIGS. 18*a,b* depict the underside of a seat for an elevating walker chair.
Figure 18B:
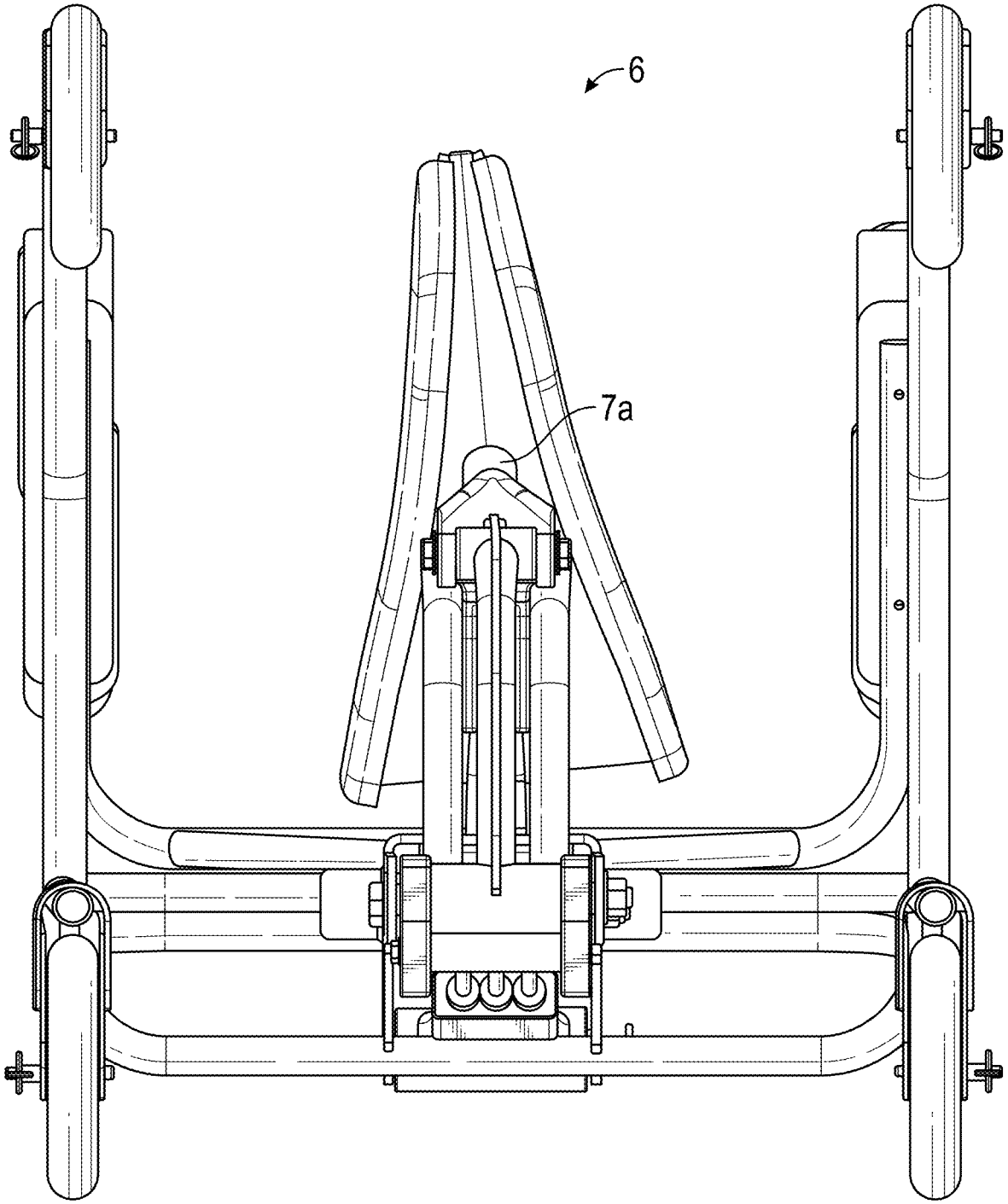

FIG. 10 depicts folding seat/saddle 6 assembly with wing 6*a* and seat mounting block 7 rendered transparent to show how seat mounting post 7*a*, rotating within seat mounting block 7 can facilitate limited dynamic side-to-side swiveling of seat/saddle 6 in order to clear a path for the occupant's rearwardly striding thighs. The novel seat-swiveling structure effectively narrows the rear width of seat 6 during vigorous ambulation, since the alternate thigh is unobstructedly heading forward as the other is swinging straight rearward in the clear path created by swinging the triangular aft end of seat 6 out of the way. FIGS. 18*a* and 18*b* show successive underside views of folded saddle/seat 6 as it swivels around the axis of seat post 7 to create an alternately unobstructed rearward path to either side. Seat 6 of the present invention is preferably adapted to swivel up to at least 15° to either side during ambulation so the wider, rear portion of the saddle moves away from the leg path and the side edge of the saddle that the impelling leg is contacting becomes parallel to the fore-aft axis of the elevating walker chair. Bumpers (not shown) or stops or merely the sides of the folded down seat wings 6*a,b* can limit the degree of seat rotation.

Figure 11B:
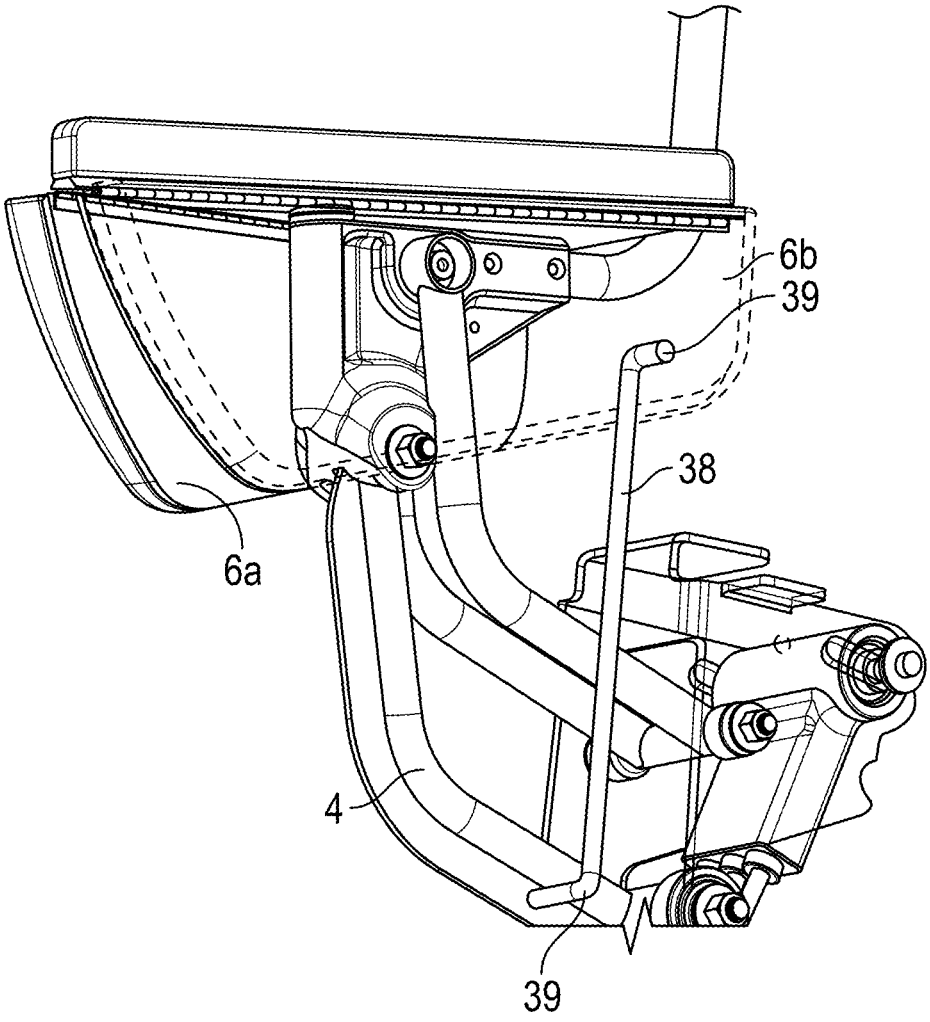

FIGS. 11*a,b* depict saddle/seat 6 in unfolded and folded positions, respectively, and show how seat wing 6*b* is swung upward by telescoping wing deployment strut 38 into seat mode as the saddle descends. Two such identical struts can be employed to simultaneously raise both seat wings 6*a,b*, but only the right-hand strut 38 is shown here for clarity. FIG. 11*a* shows an attachment mechanism that includes ball joint 39 of the upper (inner) telescoped segment of strut 38 to the underside of seat side wing 6*b*. FIG. 11*b* shows how the lower, outer section of strut 38 attaches by means of ball joint 39 and a short stand-off tube to a lower portion of parallelogram lifting strut 4, so that it has a clear path upward to wing 6*b* during the phases of seat deployment. Note that telescoping tube 38 is fully extended when saddle 6 is raised up with wing 6*b* folded down. Strut 38 only begins to raise wing 6*b* when its telescopic travel is fully retracted, as seat 6 approaches the bottom of its deployment into seat mode, as illustrated by comparison in FIGS. 11*a* and 11*b*.

Figure 12A:
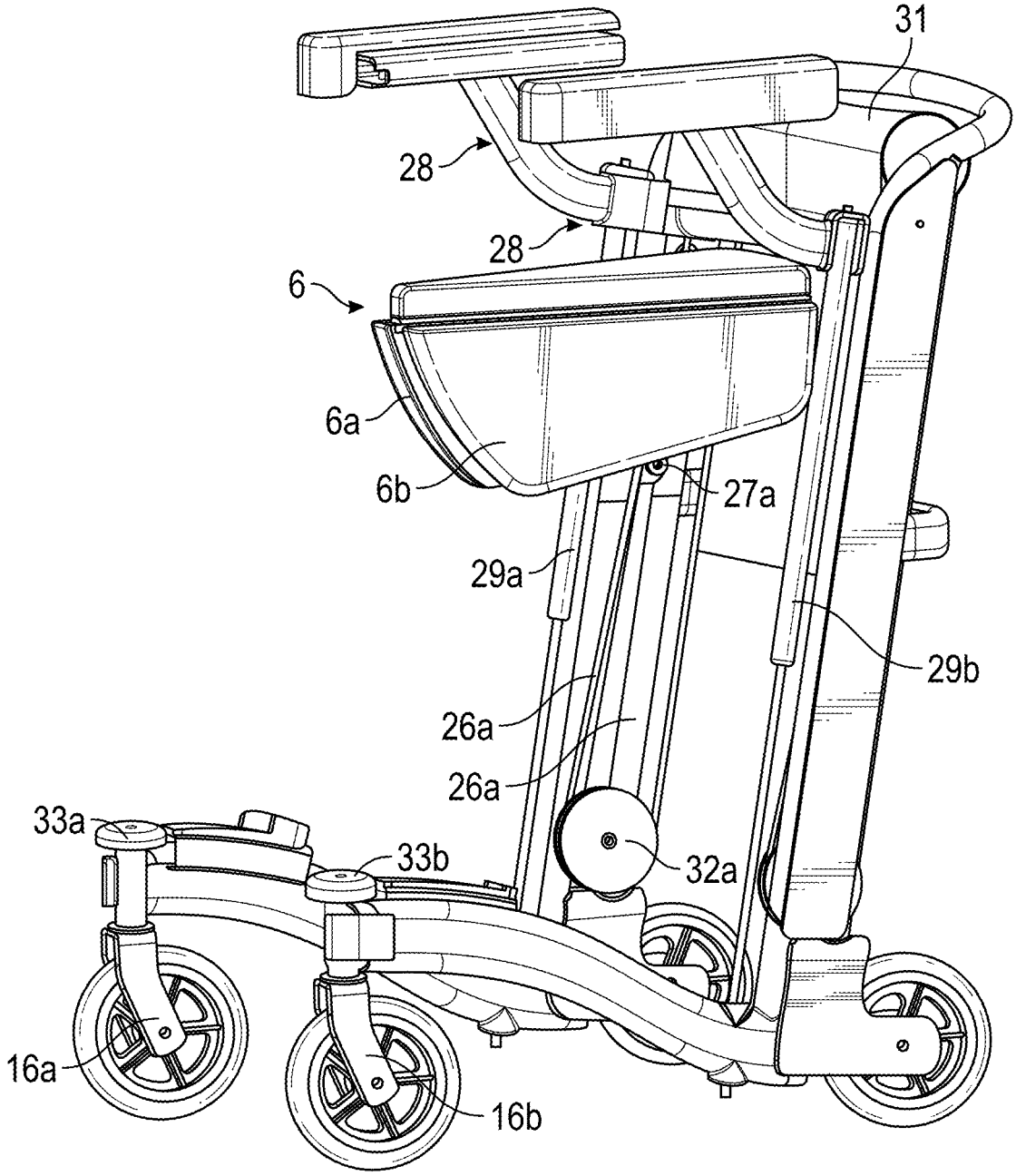
FIGS. 12*a,b* depicts an elevating lifting chair that lifts and lowers a seat carriage assembly between walking and seat heights by means of a left/right resilient member and linear bearing assemblies.
Figure 12B:
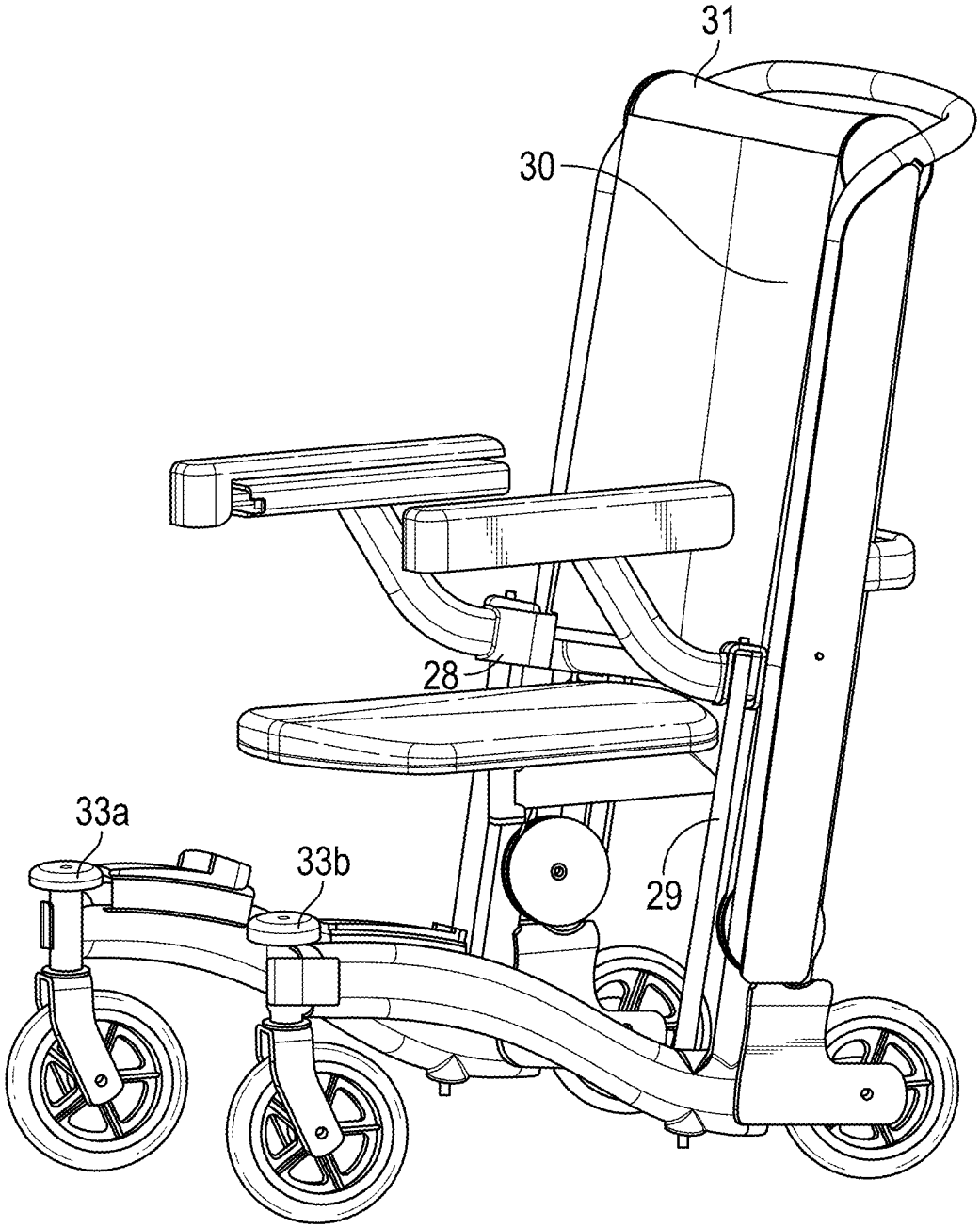
FIG. 12*c* is a perspective view of a linear bearing assembly running between a linear bearing track pair.

FIGS. 12*a,b* depict an alternate embodiment of the elevating walker chair that lifts and lowers seat carriage assembly 28 between walking and seat heights by means of left/right resilient component 29*a,b* and linear bearing assemblies 27*a,b*. FIG. 12*a* shows seat 6 up in saddle mode, with resilient component 29*b* (gas springs, for example) fully extended to cause seat carriage assembly 28 to rise up by means of left/right linear bearing assemblies 27*a,b*, and cause roller backrest fabric or covering 30 to retract up and over backrest roller assembly 31, tensioned by left/right backrest tensioning pulley assemblies 32*a,b*. The force of resilient components 29*a,b*, such as springs and gas springs, declines linearly as they extend and retract. As used here, to exert force straight along left/right linear bearing track pairs 26*a,b*, they are not 'iso-elastic' and will lift most strongly when fully compressed (or extended in the case of tensile resilient components). Consequently, the linearly powered embodiment of FIGS. 12*a,b,c* is suitable for user's who retain some leg strength and can supply the missing lifting power as seat 6 approaches the top of travel. FIG. 12*b* shows gas springs 29*a,b* fully compressed as seat carriage 28 reaches the bottom of linear bearing travel and roller backrest fabric 30 is extended and ready for use. Left/right foot-operated caster steering footplates 33*a,b* are fixedly associated with the swiveling axles of front swivel casters 16*a,b* and function as dynamic footrests that also help facilitate a form of sociable 'pushing' of the elevated chair, in which the occupant is up at eye-height or so with the attending person, who may easily push, for instance, the arm-rest (rather than necessarily rearward handles), and the footplates enable the rider to 'steer' by selectively rotating a caster to cause the chair to follow a desired path. An unaccompanied rider can also continue to 'stride' with one leg (skateboard style) and steer with the other, in order to progress in a precise direction, such as through a narrow doorway, and steering linkages between castors or elaborate steering geometry may not be required when only one castor is steered by this method.

Figure 12C:
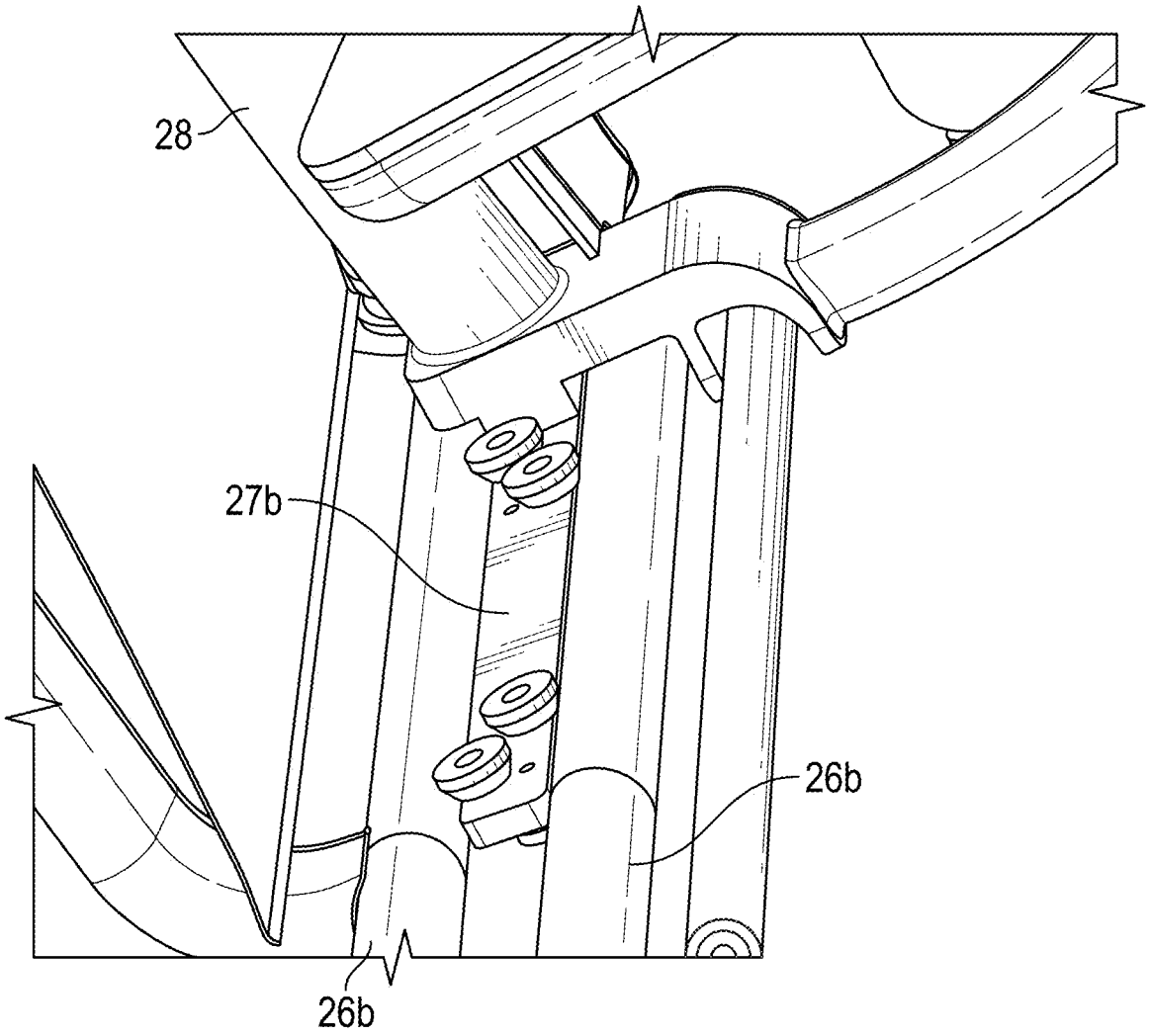

FIG. 12*c* is a close perspective view of one of two linear bearing assemblies 27*a,b* running between left/right linear bearing track pairs 26*a,b*, to raise and lower seat carriage assembly 28, to which can also be attached seat 6, actuating armrest assemblies 9*a,b*, and roller backrest fabric 30. Linear bearing assemblies 27*a,b* function by means of tapered rollers mounted to be held in contact with opposing linear bearing track pairs 26*a,b*.

Figure 13A:
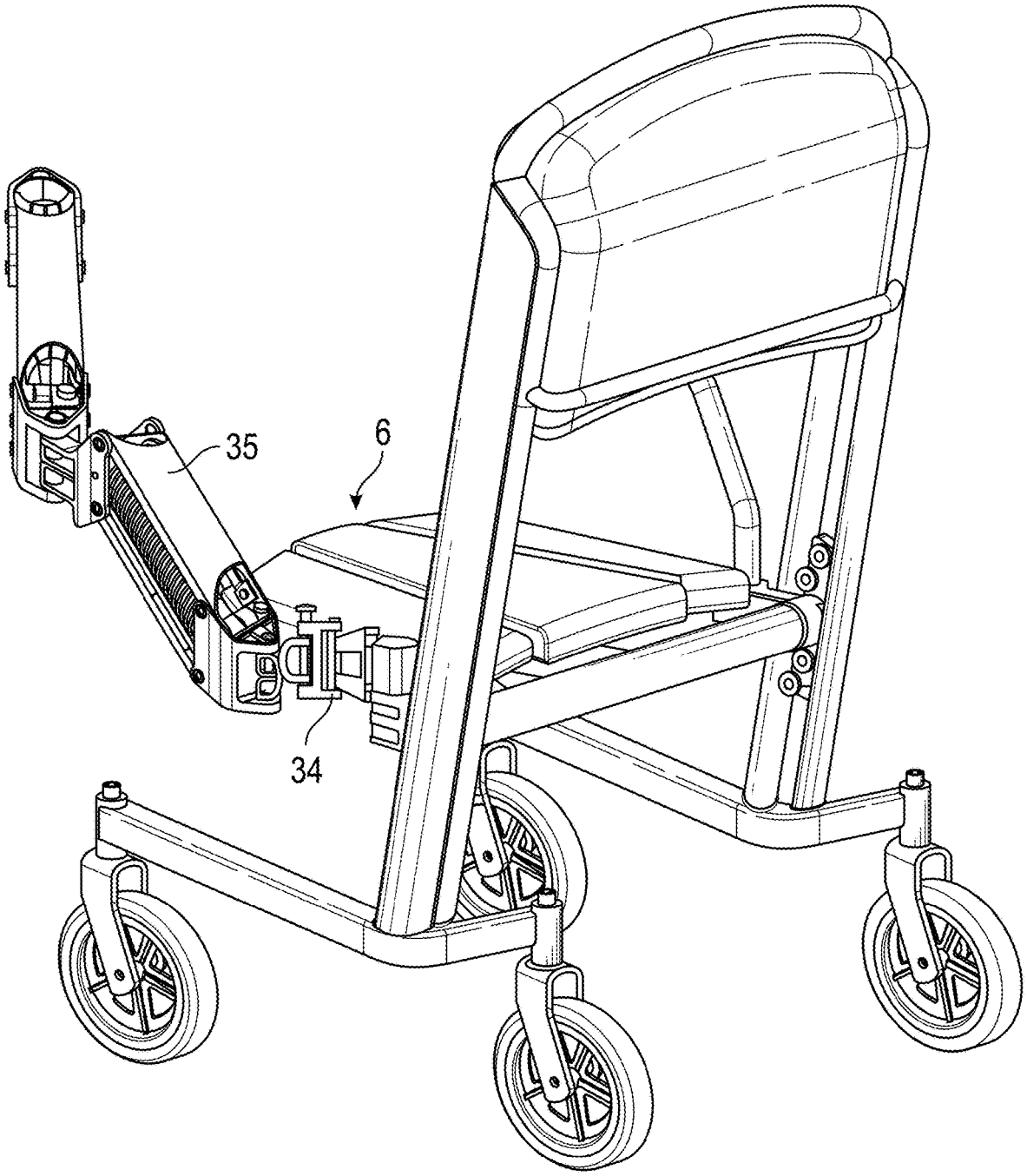
FIGS. 13*a,b* depict both low seat and elevated saddle deployments of an elevating walker chair suitable for industrial use that provides support for the combined weight of a workman or other user, a resiliently powered payload support arm and a gimbaled industrial tool payload.
Figure 13B:
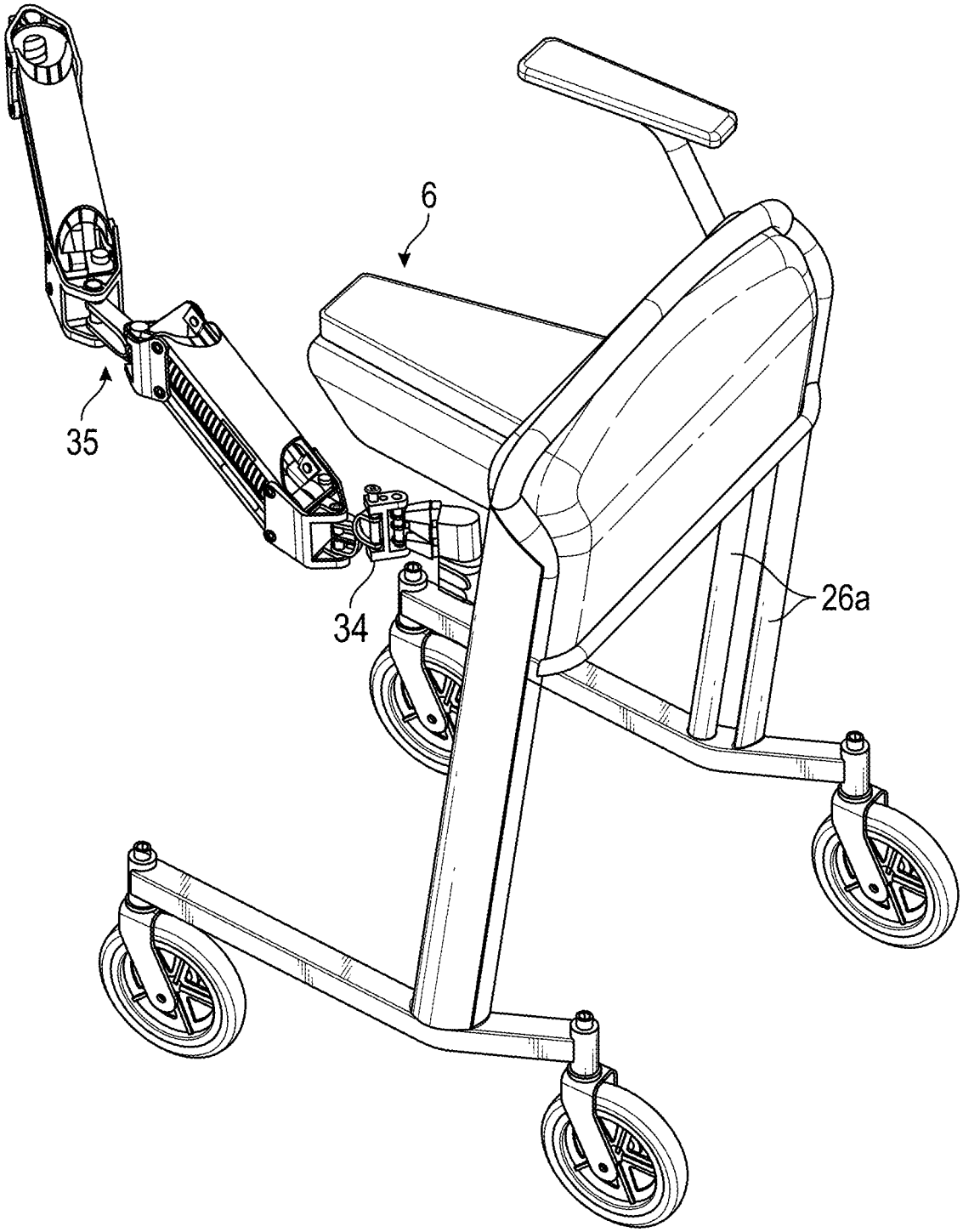
Figure 16:
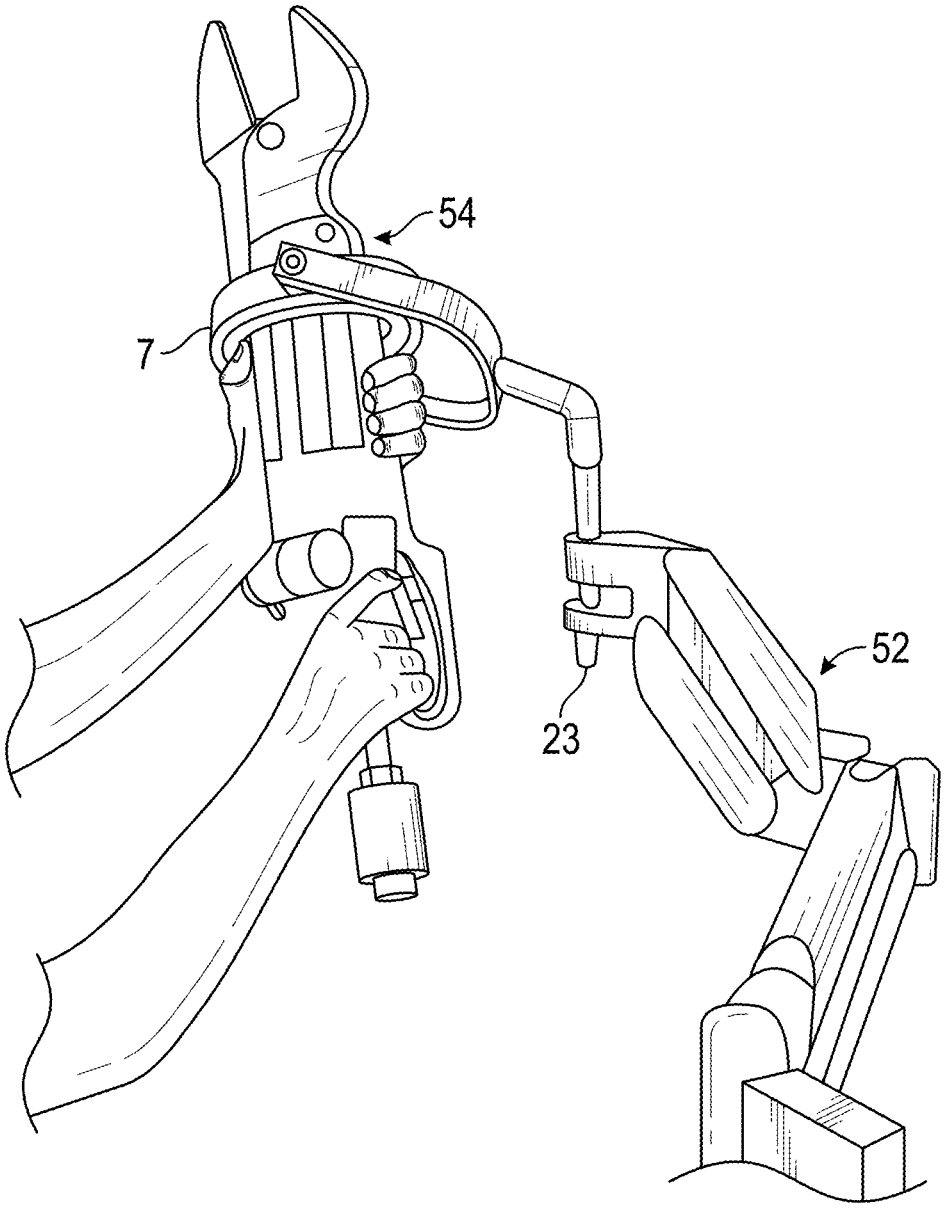
FIG. 16 depicts an articulated arm attached to a gimballed tool holder.
Figure 17A:
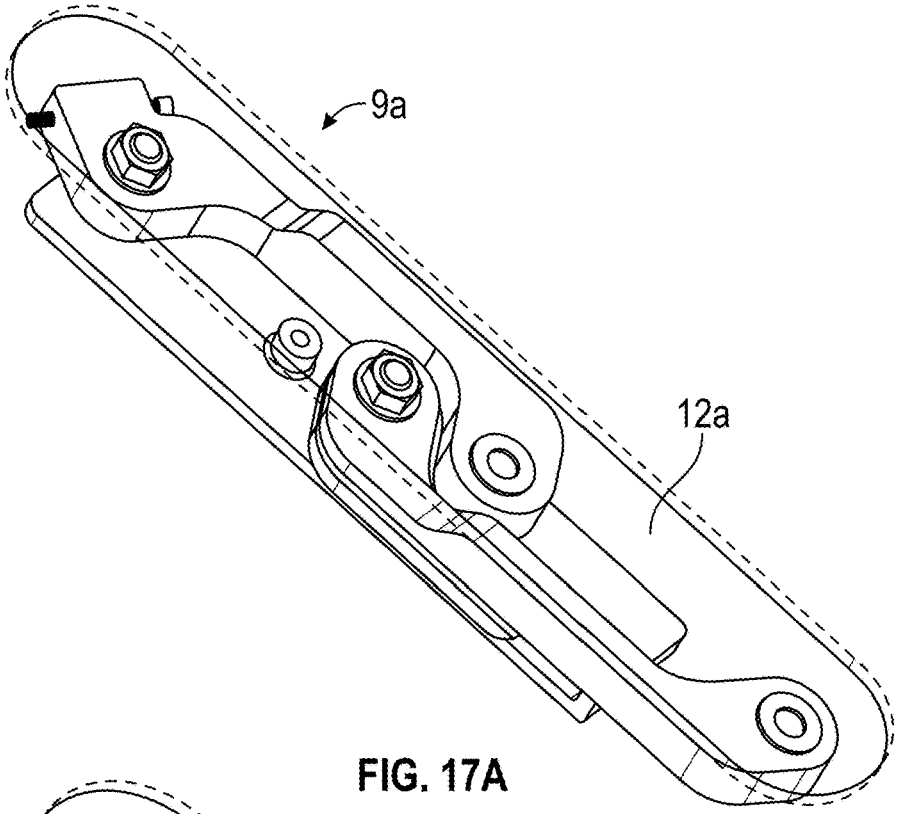
FIGS. 17*a-d* show perspective views of a right-hand actuating of the armrest assembly with a top cover plate to illustrate armrest positions yielded by excursions of fore/aft uneven-parallelogram struts.
Figure 17B:
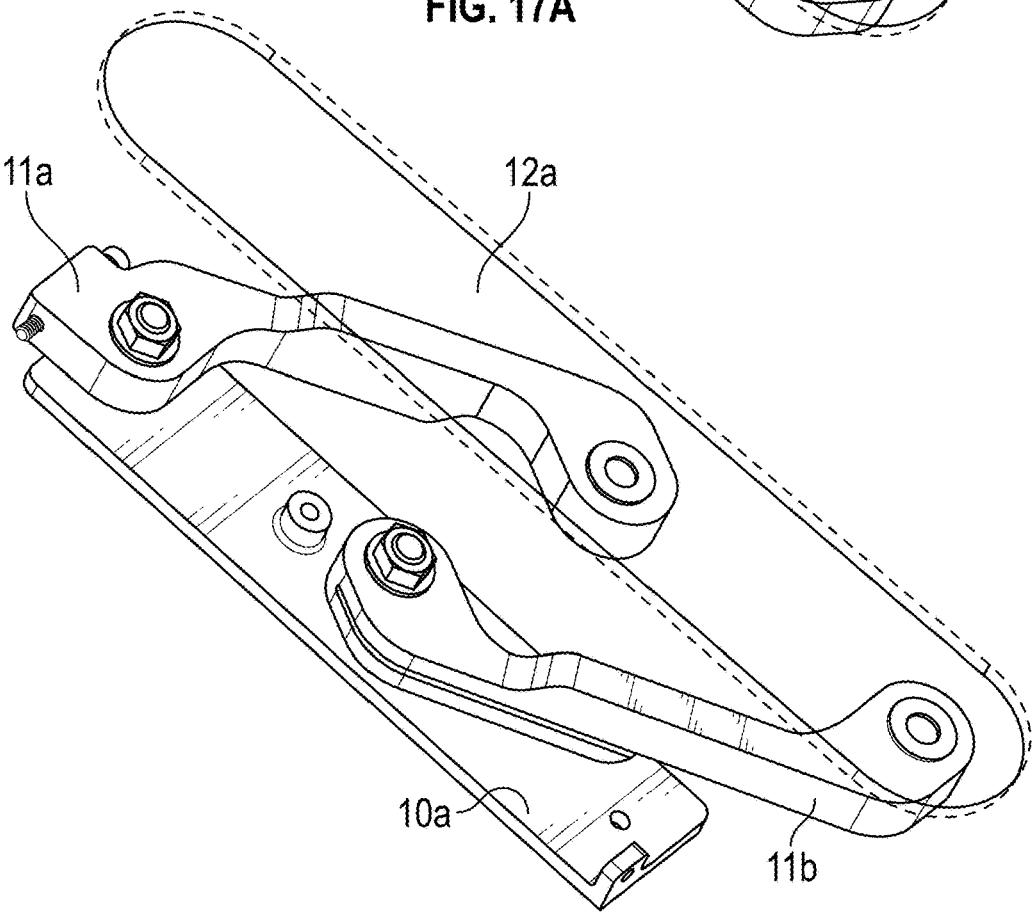
Figure 17C:
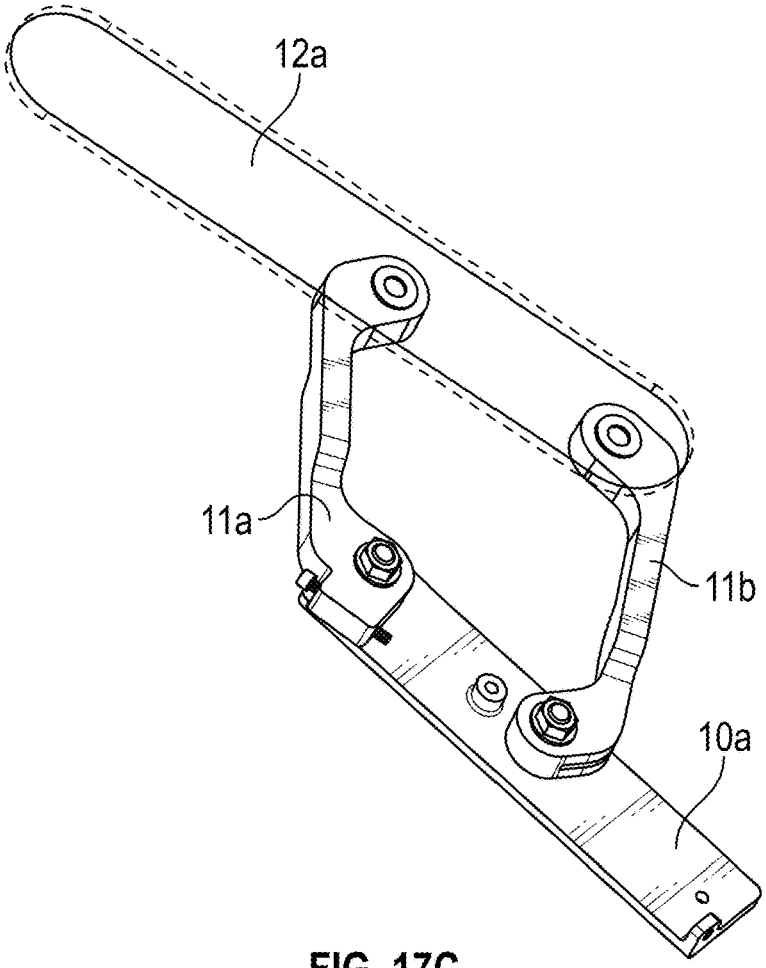
Figure 17D:
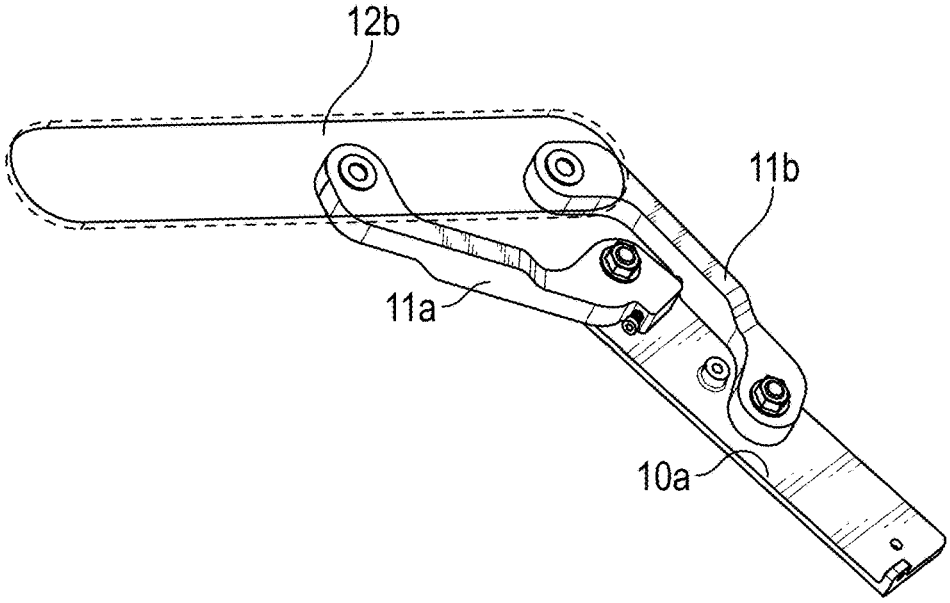

FIGS. 13*a,b* depict low (seat) and elevated (saddle) deployments, respectively, of an illustrative embodiment of the invention that provides support for the combined weight of a user (not shown), a resiliently powered payload support arm 35 such as the 'Zero-G™ support arms marketed by Equipois, LLC, or other counterbalancing or equipoising arms, and a preferably gimbaled industrial payload, such as shown in FIG. 16. FIG. 16 depicts an illustrative articulated arm 52 and a gimballed tool holder 54. Other tool holders and arms may be used as appropriate for particular application, whether industrial or to provide individuals assistance with everyday tasks. FIGS. 13*a,b* depict lifting articulated arms with two lifting links each. Each link is of a parallelogram configuration with a resilient member to provide the lifting force. The aforementioned arms may have one or more lifting links. Attached to the distal end of the lifting arm may be a hand or arm rest that would leave a user's hands free to perform a task, while being supported by the rest that is attached to the lifting arm. This embodiment of the elevating walking chair can assist deployment of heavy tools in an industrial setting which otherwise might cause, for instance, shoulder injuries from the repetitive strain of holding them outstretched for hours of work. An industrial worker can raise himself plus the arm and tool payload to 'saddle' height for relatively easy ambulation between workplace opportunities and repeatedly lower to seat height and rise back up again, depending on the altitude of any particular task.

Particular embodiments or applications of the elevating walking chair may need to more perfectly equipoise both user and payload, may therefore utilize the iso-elastic parallelogram powered embodiment illustrated in FIG. 1, with which an occupant might readily perform 'pick and place'

(otherwise called 'material handling') operations. Such an elevating walker chair would preferably be configured to allow heavy items to be picked up and transported with little effort and little risk of injury, by lowering a worker to chair height, engaging the arm with the payload, rising up with minimal leg effort, maneuvering the payload to its resting place, and sinking down to unload the arm (which may be conveniently restrained at any selected maximum height). This procedure displaces the weight of the transported payload from the hands to the much more powerful thighs and calves, and 'floats' the worker's own weight throughout the 'pick and place' operation.

Figure 14:
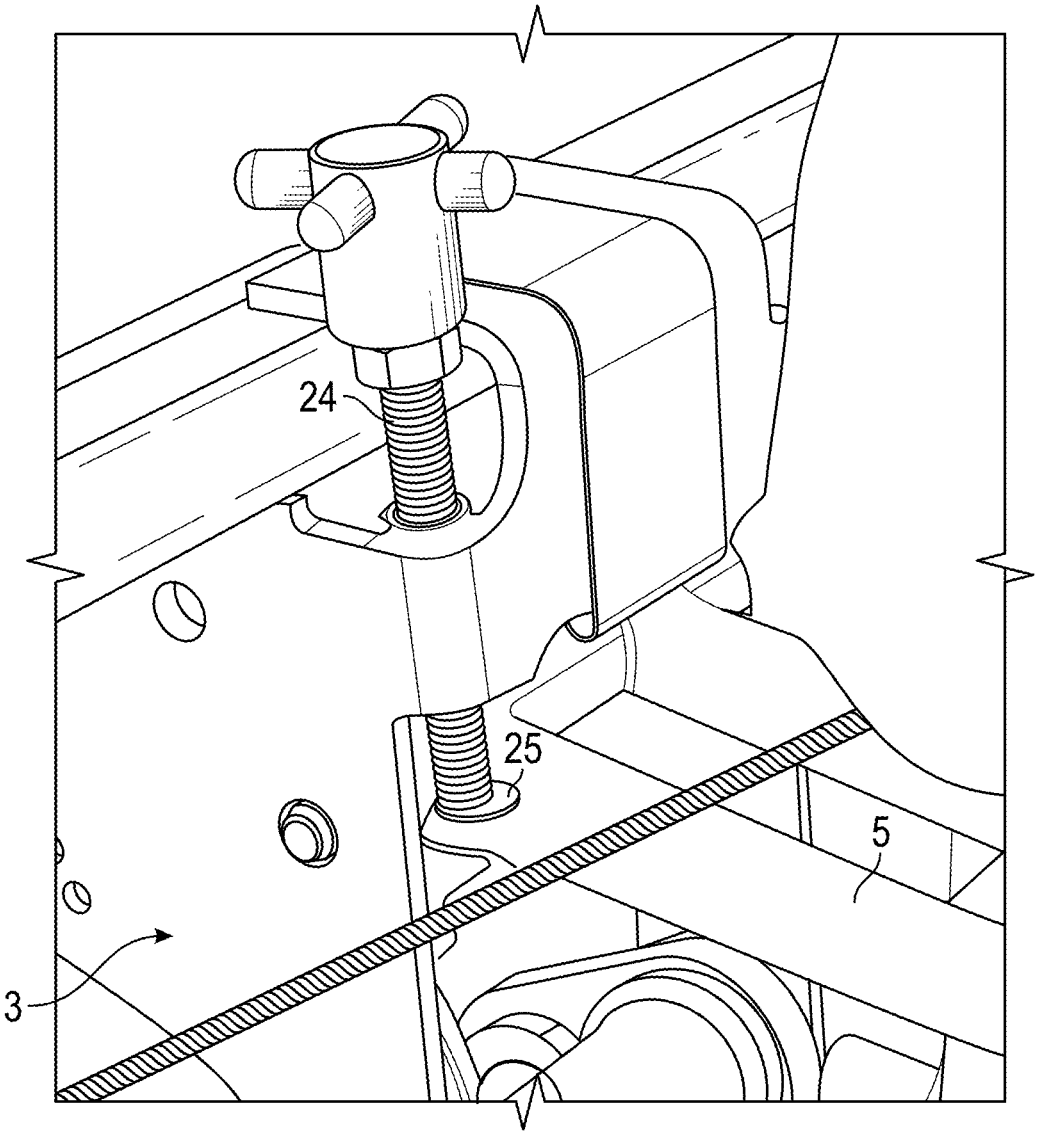
FIG. 14 depicts a maximum height adjusting screw and striker plate function to set maximum saddle height as appropriate for rider's inseam measurement.

FIG. 14 depicts maximum height adjusting screw 24 and striker plate 25 functioning to restrain one of upper parallelogram struts 5*a,b* in order to set maximum saddle height as appropriate for the user's inseam measurement, and to ensure that height saddle/seat 6 is appropriately restrained to ease his or her 'get aboard' transition from an adjacent unsupported standing position—as well as to set the optimum saddle height for ambulation.

Figure 15A:
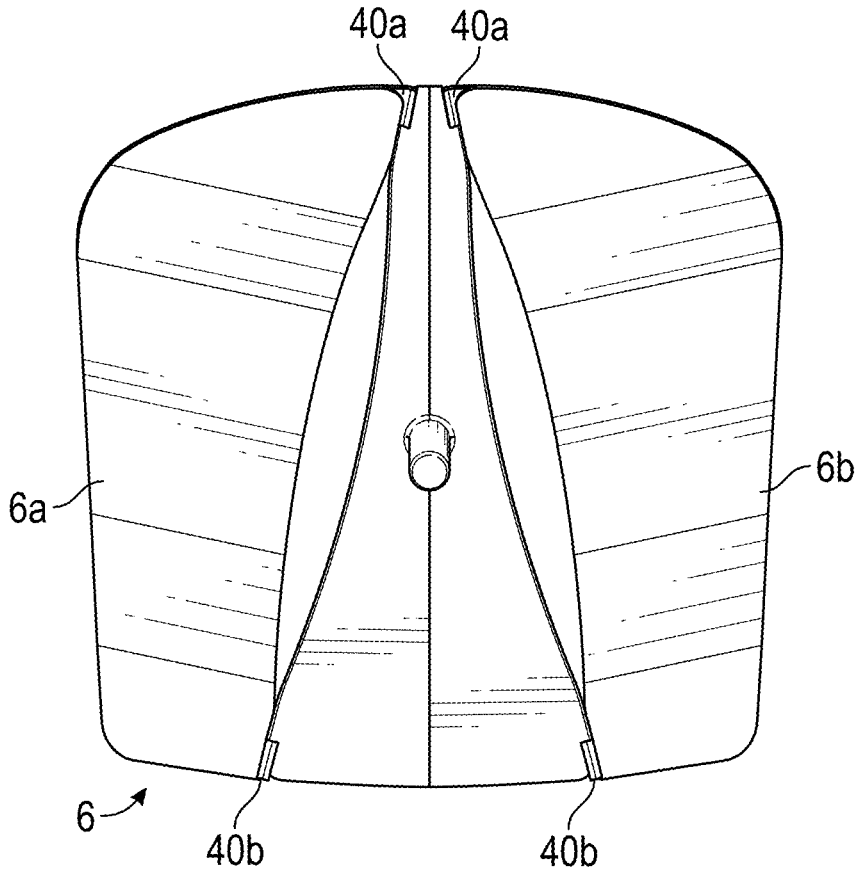
FIGS. 15*a,b,c* depict a seat for an elevating lifting chair than transforms from a seat shape to a saddle shape.
Figure 15B:
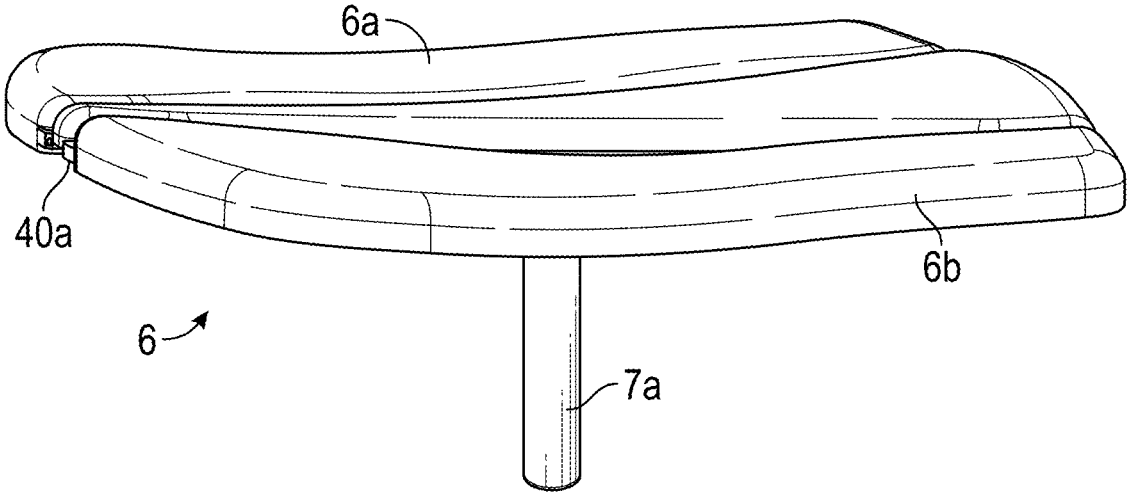
Figure 15C:
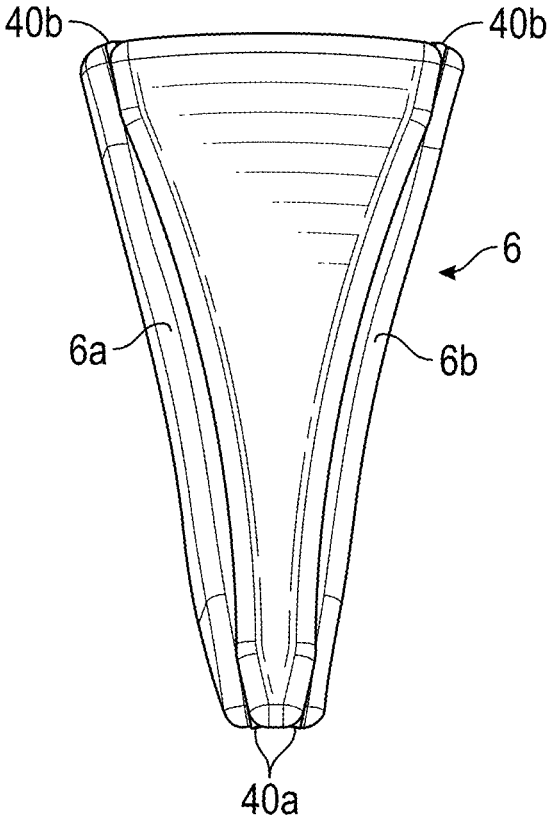

FIGS. 15*a,b,c* depict an illustrative embodiment of folding seat/saddle 6 that is curved to be ergonomically compatible with the human form in both the unfolded 'seat' mode and the folded 'saddle' mode, and that provides the narrowness forward appropriate for male riders and the somewhat increased width slightly farther aft that is generally more comfortable for women. FIG. 15*a* is an underside view that shows seat folding relief cut-outs 41*a,b* that permit the slightly curved plane of seat 6, including wings 6*a,b* and the central triangular portion to join closely together when folded, yet still preserve optimal narrowness at the forward area as a saddle. Shown are fore/aft hinge sets 40*a,b*, configured in a v-pattern to fold into a pointed saddle-shape approximately an inch wide in front and 6 inches wide at the rear. Fore and aft components of hinge sets 40*a,b* are positioned in line with each other but interrupted in between by left and right folding seat relief cut-outs 41*a,b*. FIG. 15*b* shows the extremely shallow curve imposed on the entire unfolded top surface of seat 6, as if it were cut from a cylindrical section of extremely large radius. The result of this large-radius, 'master' curvature and cut-outs 41*a,b*, in combination with hinge sets 40*a,b*, is an upholstered shape that, in FIG. 15*c* can be seen to fold into a saddle shape of exemplary narrowness. Upholstery materials, such as gel sections and elastic covering materials are preferably used so seat 6 remains narrow but is comfortably padded, when folded into a saddle, as well as when unfolded into a seat. Non-upholstered saddles are also an option.

The topology of this master curve compounds when folded and helps prevent bulging of upholstery when unfolded, as the radius of folding has not increased as much as it would around intact straight hinge lines. Excess material can 'cut the corner' and be drawn inward into the cut-out gaps when folded and resiliently released when unfolded. Strong flexible outer covering material will also help ensure that a rider's clothing is not pinched by the sides of cut-outs 41*a,b* as they close together. Note that as the radius of the master curvature decreases, and the width of folding relief cut-outs 41*a,b* increases, the folded saddle becomes progressively narrower.

The concept of 'iso-elasticity' as relates to lifting means is explained by Garrett W. Brown's various patents, including, U.S. Pat. Nos. 8,066,251; 5,360,196; 7,618,016; 5,435,515; Re. 32,213; 6,030,130; 4,394,075; and 4,208,028 (incorporated herein by reference).

Various embodiments of the invention have been described, each having a different combination of elements. The invention is not limited to the specific embodiments disclosed, and may include different combinations of the elements disclosed or omission of some elements and the equivalents of such structures.

While the invention has been described by illustrative embodiments, additional advantages and modifications will occur to those skilled in the art. Therefore, the invention in its broader aspects is not limited to specific details shown and described herein. Modifications may be made without departing from the spirit and scope of the invention. Accordingly, it is intended that the invention not be limited to the specific illustrative embodiments, but be interpreted within the full spirit and scope of the appended claims and their equivalents.

The invention claimed is:

1. An elevating walker chair comprising:

a frame having a plurality of wheels attached thereto creating a rollable structure;

the frame having a front and a back, the front being the side of the elevating walker chair that leads when an occupant is ambulating in a forward motion;

the frame configured so the occupant of the elevating walker chair accesses the chair from the front;

a lifting unit;

the lifting unit comprising:

a lifting chassis attached to the frame;

the chassis having a parallelogram structure with an extension frame attached to a lifting strut that form sides of the parallelogram; and a resilient member attached to the extension frame via a receiver bar;

a saddle to support the occupant;

the lifting unit capable of elevating the saddle;

the lifting unit capable of counterbalancing the occupant's weight at least in part thereby reducing a force needed for the occupant to move from a seated position to a more erect position; and two armrests having a plurality of positions:

wherein in a first position the wheels are locked;

a second position wherein the wheels are unlocked and a seat height is locked; and a third forward position that locks a height of the saddle and frees the wheels, but allows a user to lean forward onto the armrests.

2. The elevating lifting chair of claim 1 wherein:

the saddle is transformable from a saddle to a seat; and the lifting unit is functionally attached to the saddle so that the saddle transforms to a seat upon lowering and the seat transforms to a saddle upon elevation.

3. The elevating walker chair of claim 1 wherein the saddle swivels.

4. The elevating walker chair of claim 3 wherein a degree of swivel rotation of the saddle about a vertical axis is about +−15 degrees.

5. The elevating walker chair of claim 2 wherein the saddle has a central portion and a right wing and a left wing, wherein each wing is attached to the seat central portion at two hinges positioned at opposing ends of interfaces between the seat central portion and the left and right wing.

6. The elevating walker chair of claim 2 comprising a telescoping strut deployment mechanism for transforming the occupant support between a seat and a saddle.

7. The elevating walker chair of claim 1 further comprising:

a seat back frame;

a right armrest assembly attached to the seat back frame;

a left armrest assembly attached to the seat back frame;

the right and left arm rest assemblies each having:

an armrest support plate attached to the seat back frame;

a first deployment strut and a second deployment strut of a different length than the first deployment strut, each of the first and second deployment struts having a proximate end and a distal end, each pivotally attached at their proximate ends to the armrest support plate;

an armrest cover plate to which the distal ends of the first deployment strut and the second deployment strut are pivotally attached, such that the armrest support plate, the armrest cover plate and the first and second deployment struts form a four-sided structure;

wherein, the difference in length between the first deployment strut and the second deployment strut causes the cover plate to cross in front of the occupant as the first and second deployment struts are pivoted with respect to the armrest support plate.

8. The elevating walker chair of claim 7 wherein the arm rest assemblies are configured to lock and unlock the seat in a selected vertical position and locking and unlocking at least one of the plurality of wheels.

9. The elevating walker chair of claim 1 wherein at least two of the lifting unit parallelogram sides are non-linear between pivot points.

10. The elevating walker chair of claim 1 wherein the lifting unit has one or more lifting power units;

the lifting power units are configured to be exchangeable by having universal fittings; and the lifting unit can accommodate different combinations of different power units.

11. The elevating walker chair of claim 7 wherein an angle between the lifting unit extension frame centerline and a force applied by the resilient member is in a range of about 27° to about 31°.

12. The elevating walker chair of claim 11 wherein an angle between a lifting unit extension frame centerline and a force applied by the resilient member is about 29°.

13. The elevating walker chair of claim 1 wherein an angle between a lifting unit extension frame centerline and a force applied by the resilient member is in the range of about 46° to about 50°.

14. The elevating walker chair of claim 13 wherein an angle between a lifting unit extension frame centerline and a force applied by the resilient member is about 48°.

15. The elevating walker chair of claim 1 wherein a range of height variations between a seat position and a saddle position is about 18 inches to about 34 inches.

16. The elevating walker chair of claim 7 comprising crankshafts disposed within at least one of the right armrests or left armrests, wherein the crankshafts are functionally attached to actuating wires, wherein the crankshafts are adapted to pull the actuating wires to engage and release wheel brakes, seat height locks, or both by movement of the right cover plate or the left cover plate.

17. A method of rehabilitation comprising:

performing physical rehabilitation using an elevating walker chair according to claim 1.

18. The elevating walker chair of claim 1 wherein an angle between a lifting force and a lifting extension centerline is adjustable.

19. The elevating walker chair of claim 1 wherein the elevating walker chair is adapted to be motorized.

20. The elevating walker chair of claim 19 comprising wireless control of motorized functions.

21. The elevating walker chair of claim 1 wherein a seat height maximum limit is set by an adjustment screw and a limiting striker plate adapted to limit a seat height.

22. The elevating walker chair of claim 1 comprising:

a right armrest and a left armrest, each having a plurality of positions;

a braking mechanism that can be activated by movement of one or both of the armrests, and which upon braking to substantially eliminate a rolling motion a seat lowers the occupant toward a seated position.

23. An elevating walker chair comprising:

a frame having a plurality of wheels attached thereto creating a rollable structure;

the frame having a front and a back, the front being the side of the elevating walker chair that leads when an occupant is ambulating in a forward motion;

the frame configured so the occupant of the elevating walker chair accesses the chair from the front;

a lifting unit;

the lifting unit comprising:

a lifting chassis attached to the frame;

the chassis having a parallelogram structure with an extension frame attached to a lifting strut that form sides of the parallelogram; and a resilient member attached to the extension frame via a receiver bar;

a saddle to support the occupant;

the lifting unit capable of elevating the saddle; and the lifting unit capable of counterbalancing the occupant's weight at least in part thereby reducing a force needed for the occupant to move from a seated position to a more erect position;

wherein the lifting unit extension frame is pivotally attached to the lifting strut;

the lifting unit extension has a proximate pivot and a distal pivot;

the lifting strut has a proximate pivot and a distal pivot, wherein the lifting strut distal pivot is coincident with the lifting unit extension proximate pivot; and the lifting unit extension frame and the lifting strut have a length ratio of about 6.9:1, wherein the length of the lifting unit extension frame is measured from its proximate pivot to its distal pivot and the length of the lifting strut is measured from its proximate pivot to its distal pivot, and both the lifting unit extension frame and the lifting strut lengths are measured in a straight line whether or not each is bent or straight.

24. The elevating lifting chair of claim 23 comprising:

two armrests having a plurality of positions:

wherein in a first position the wheels are locked;

a second position wherein the wheels are unlocked and a seat height is locked; and a third forward position that locks a height of the saddle and frees the wheels, but allows a user to lean forward onto the armrests.

* * * * *